US005563634A

United States Patent [19]

Fujii et al.

[11] Patent Number: 5,563,634

[45] Date of Patent: Oct. 8, 1996

[54] INK JET HEAD DRIVE APPARATUS AND DRIVE METHOD, AND A PRINTER USING THESE

[75] Inventors: Masahiro Fujii; Ikuhiro Miyashita; Hiroshi Koeda, all of Suwa, Japan

[73] Assignee: Seiko Epson Corporation, Tokyo, Japan

[21] Appl. No.: 274,184

[22] Filed: Jul. 12, 1994

[30] Foreign Application Priority Data

Jul. 14, 1993 [JP] Japan ..... 5-174508
Jul. 19, 1993 [JP] Japan ..... 5-178140

[51] Int. Cl.[6] ..... B41J 2/04; B41J 2/095

[52] U.S. Cl. ..... 347/9; 347/54

[58] Field of Search ..... 347/54, 20, 68, 347/11, 9, 10

[56] References Cited

U.S. PATENT DOCUMENTS

| | | | |
|---|---|---|---|
| 3,440,873 | 4/1969 | Eichelberger | 73/141 |
| 3,614,678 | 10/1971 | Engeler | 333/72 |
| 3,634,727 | 1/1972 | Polye | 317/231 |
| 3,918,019 | 11/1975 | Nunn | 338/42 |
| 3,938,175 | 2/1976 | Jaffe et al. | 357/26 |
| 3,949,246 | 4/1976 | Lohrmann | 310/8.6 |
| 3,952,234 | 4/1976 | Birchall | 31/246 |
| 4,180,225 | 12/1979 | Yamada | 347/76 |
| 4,203,128 | 5/1980 | Guckel et al. | 357/60 |
| 4,354,197 | 10/1982 | Reitberger | 347/55 |
| 4,459,601 | 7/1984 | Howkins | 349/68 |
| 4,471,363 | 9/1984 | Hanaoka | 347/10 |
| 4,509,059 | 4/1985 | Howkins | 347/10 |
| 4,520,375 | 5/1985 | Kroll | 347/54 |
| 4,577,201 | 3/1986 | Murakami | 346/140 |
| 4,604,633 | 8/1986 | Kimura et al. | 347/7 |
| 4,744,863 | 5/1988 | Guckel et al. | 156/653 |
| 4,814,845 | 3/1989 | Kurtz | 357/26 |
| 4,853,669 | 8/1989 | Guckel et al. | 338/4 |
| 4,996,082 | 2/1991 | Guckel et al. | 427/99 |
| 5,022,745 | 6/1991 | Zayhowski et al. | 350/608 |
| 5,189,777 | 3/1993 | Guckel et al. | 29/424 |

FOREIGN PATENT DOCUMENTS

| | | | |
|---|---|---|---|
| 0437106 | 7/1991 | European Pat. Off. . | |
| 0479441 | 4/1992 | European Pat. Off. . | |
| 61-263776 | 11/1986 | Japan . | |
| 61-59911 | 12/1986 | Japan . | |
| 2-24218 | 5/1990 | Japan . | |
| 2-51734 | 11/1990 | Japan . | |
| 2-289351 | 11/1990 | Japan . | |
| 4-344250 | 11/1992 | Japan | 347/54 |

*Primary Examiner*—Benjamin R. Fuller
*Assistant Examiner*—Craig A. Hallacher
*Attorney, Agent, or Firm*—Eric B. Janofsky

[57] ABSTRACT

An ink jet printer provided with an ink jet print head having a nozzle, an ink channel that is connected to the nozzle, and an electrostatic actuator that is composed of a diaphragm that is provided in a part of the ink channel and an electrode placed outside of the ink channel opposite to the diaphragm. The diaphragm is distorted by means of an electrostatic force generated by applying a first voltage to the electrostatic actuator. A second voltage, different than the first voltage, is applied to the actuator to relax the diaphragm and to discharge ejecting ink droplets from the nozzle.

24 Claims, 24 Drawing Sheets

5:diaphragm(common electrode)
21:individual electrodes
V=0
46
S

ΔV1
ΔV3= ΔV1−ΔV2
V=30

ΔV2
V=0

V=40

ΔV4
V=0

ΔV5= ΔV1−ΔV4
V=30
5
21

INK JET HEAD DRIVE APPARATUS AND DRIVE METHOD, AND A PRINTER USING THESE

CROSS-REFERENCE TO RELATED APPLICATIONS

This application is related to the following commonly-assigned, co-pending patent application:

"Ink-Jet Head Printer and Its Control Method", Ser. No. 08/259,656, filed Jun. 14, 1994. Application Ser. No. 08/259,656 is incorporated herein by reference.

BACKGROUND OF THE INVENTION

1. Field of the Invention

The present invention relates to a drive method and drive apparatus for an ink-on-demand type ink jet head, and particularly to a drive method and drive apparatus for eliminating the effects of residual charges in the diaphragm of an electrostatic ink jet head actuator.

2. Description of the Related Art Ink jet recording apparatuses offer numerous benefits, including extremely quiet operation when recording, high speed printing, a high degree of freedom in ink selection, and the ability to use low-cost plain paper. The so-called "ink-on-demand" drive method whereby ink is output only when required for recording is now the mainstream in such recording apparatuses because it is not necessary to recover ink not needed for recording.

The ink jet heads used in this ink-on-demand method commonly use a piezoelectric device for the drive means as described in JP-B-1990-51734, or ejection of the ink by means of pressure generated by heating the ink to generate bubbles as described in JP-B-1986-59911.

Japanese Patent Laid-open No. 1990-24218 also describes a drive method having a piezoelectric device. This drive method comprises a piezoelectric device for varying the volume of the pressure chamber generating the ink eject pressure. During the printer standby state, an electrical pulse is applied to the piezoelectric device in the same direction as the polarization voltage of the piezoelectric device, thereby charging the piezoelectric device and reducing the volume of the pressure chamber. To eject the ink during printing, the piezoelectric device is gradually discharged to increase the volume of the pressure chamber, and an electrical pulse is again applied to the piezoelectric device to rapidly charge the device and decrease the pressure chamber volume, thereby ejecting ink from the nozzle. To eject the ink with greatest efficiency at a low voltage level, a voltage is again applied to the piezoelectric device to rapidly decrease the pressure chamber volume near the peak value of the damped vibration of the ink supply system occurring when ink is suctioned into the pressure chamber.

The following problems, however, are presented by these conventional ink jet heads.

In the former method using a piezoelectric device, the process of bonding the piezoelectric chip to the diaphragms used to produce pressure in the pressure chamber is complex. With current ink jet recording apparatuses having plural nozzles and a high nozzle density to meet the demand for high speed, high quality printing, these piezoelectric devices must be precisely manufactured and bonded to the diaphragms, processes that are extremely complicated and time-consuming. As the nozzle density has increased, it has become necessary to process the piezoelectric devices having a width in the order of magnitude of several ten to hundred microns. With the dimensional and shape precision achievable using current machining processes, however, it is difficult to manufacture with precision such devices. Accordingly, there is a wide variation in print quality.

In the latter method whereby the ink is heated, the drive means is a thin-film resistive heater that generally eliminates the above problems. However, this type of device has other problems. For example, the resistive heater has a tendency to become damaged over time, and the practical service life of the ink jet head is accordingly short. This is believed to be caused by the repeated rapid, heating and cooling of the drive means and the impact of bubble dissipation.

An ink jet head using an electrostatic actuator is described in U.S. Pat. No. 4,520,375. This type of ink jet head is provided by a pair of spaced capacitor plates, one of which is a thin diaphragm, preferably of semiconductor material, such as silicon, and a reservoir containing a fluid, such as ink. The diaphragm communicates with a nozzle. Impressing a time varying voltage on the capacitor causes the diaphragm to be set into mechanical motion, and the fluid to exit through the nozzle responsive to the diaphragm motion.

However, the drive apparatus or method that efficiently utilizes the characteristics of the semiconductor substrate to drive the ink jet head employing an electrostatic force has not been described in detail. In these conventional devices, it has not been possible to assure more stable drive characteristics.

One problem is that there may be a large difference in the current value according to the polarity of the applied voltage in the contact of the metal and semiconductor in the electrode because of the affect of the space-charge layer (also known as "depletion layer").

The space-charge layer is regarded as a capacitor not a conductor, and causes undesirable phenomena for an actuator of an ink jet head, for example, a decrease in displacement of the diaphragm, or an increase of the drive voltage to eject the ink droplets.

Regarding this problem, in U.S. Pat. No. 4,520,375, a time varying voltage is impressed on the capacitor which causes the diaphragm to be set into mechanical motion and the fluid to exit responsive to the diaphragm motion. However, U.S. Pat. No. 4,520,375 provides little guidance about the characteristics of semiconductor materials or few details on how to effectively drive such a print head.

In the case of the capacitor plate having the diaphragm is P-type semiconductor substrate and an alternating voltage having no bias voltage is applied to the actuator, the substrate acts as a conductor when a positive charge is applied to the substrate electrode, but when a negative charge is applied, the substrate does not act as a conductor and has capacitance due to the presence of the space-charge layer. As a result, the displacement of the diaphragm having applied a positive voltage is different from that having applied a negative voltage. As a result of this condition, there is a tendency of the ink droplets not being ejected uniformly, which deteriorates a print quality.

In another example, an alternating voltage is added to a bias voltage so that the polarity of voltage applied to the diaphragm is fixed. In this situation, a very large voltage is needed to deform the diaphragm and eject ink due to the presence of the space-charge layer if the applied voltage has an unsuitable polarity.

The following is a detailed description of the operation principal of an electrostatic actuator for applying to ink jet head.

When a voltage is applied to the gap between the diaphragm and an oppositely placed electrode, the resulting electrostatic force causes the electrode to attract the diaphragm, thus bending it. On the other hand, when bent, the diaphragm generates a restoring force in the opposite direction. Therefore, the extent of the bending of the diaphragm during the application of a voltage to the electrostatic actuator, i.e., the displacement of the mid-section of the diaphragm (hereinafter referred to as "the extent of the diaphragm displacement" or "diaphragm displacement") represents a value at which the electrostatic force and the diaphragm's restoring force are in equilibrium. If P denotes the restoring force of the diaphragm, x the displacement, and C the compliance of the diaphragm, the three variables can be expressed in the following equation:

$$P=x/C \quad (1)$$

Likewise, if Va denotes the effective voltage, G the distance between the diaphragm and the electrode (hereinafar "electric gap length"), and e the permittivity of the gap, then the electrostatic force generated between the diaphragm and the electrode can be expressed as:

$$P=e/2\{Va/(G-X)\}^2 \quad (2)$$

The position at which the displacement of the diaphragm comes into equilibrium can be determined from Equations (1) and (2).

FIG. 26 is a characteristic chart depicting the relationship between the displacement and the restoring force of the diaphragm and the relationship between the displacement of the diaphragm and the electrostatic force that is generated. These relationships are obtained from Equations (1) and (2), respectively. In the figure, diaphragm displacement x is plotted on the horizontal axis, and the pressure generated by the restoring force of the diaphragm and the pressure generated by the electrostatic force are plotted on the vertical axis. The following parameters, used in the experiment, are also used in the calculations:

$$C=5\times10^{-18}\ [m^5/N],\ G=0.25\ [\mu m],\ e=8.85\ [pF/m]$$

The electrostatic forces, calculated for each applied voltage, are shown by curves in the figure. The relationship between the diaphragm displacement and the diaphragm restoring force is indicated by a straight line. Of two intersections between the straight line and each curve, the intersection on the left side indicates the extent of bending (displacement quantity) of the diaphragm at the particular voltage level that is applied. At a voltage level at which the restoring force and the electrostatic force of the diaphragm do not intersect (e.g., 35 V), the electrostatic force is always greater than the restoring force of the diaphragm, irrespective of the displacement of the diaphragm. Therefore, in this case the displacement tends toward infinity. In actuality, however, the existence of an oppositely placed electrode limits the displacement of the diaphragm to the position of the electrode. In applying such electrostatic actuators as described above to ink jet heads for actual printer products, there remain some problems to be solved as described below.

Improving the printing speed of a printer requires an increase in the frequency in which the ink jet head pumps out ink continuously, i.e., the response frequency of the ink jet head. When attempting to achieve a high response rate for the diaphragm, if the volume of the ink ejection chamber is increased rapidly by applying sudden pulse voltages and by supplying an electrical charge between the diaphragm and the electrode, in order to attract the diaphragm to the electrode rapidly, air bubbles intrude into the ink ejection chamber from the nozzle connected to the ink channel. In other words, the rapid vibrations of the ink in the ink ejection chamber cause the gases dissolved therein, such as the nitrogen, to bubble up. As a result of these bubbles in the ink ejection chamber, any increase in pressure due to the decrease in volume of the ink ejection chamber caused by the sudden discharge of the electrical charge accumulated between the diaphragm and the electrode is absorbed or attenuated by the bubbles, thus preventing effective ink ejection. Further, the rapid attraction of the diaphragm to the electrode causes secondary vibrations of the diaphragm which often causes the violent collision of the diaphragm against opposing electrode resulting in damage to the ink jet head.

In addition to the above problem, electrostatic actuators tend to be driven improperly by external noise and induction noise because they can be driven by a few electrical charge. In particular, since the electrostatic actuators of the on-demand type printers are often driven separately from their neighboring electrostatic actuators, the neighboring electrostatic actuators sometimes operate improperly due to the induction noise generated by the driving current for the electrostatic actuator disposed side by side. Also in the operation of this kind of printers, the driving interval, namely the period between one ink ejection and the next ink ejection, often becomes fairly long. In such cases, the problem of malfunction caused by external noise arises.

The inventors have observed conventional ink jet head drive method is a very viable method for driving ink jet heads using a piezoelectric device as the actuator. However, when a piezoelectric device drive method as described above is simply applied in the ink jet head using an electrostatic actuator as shown U.S. Pat. No. 4,520,375, however, the following problems make a practical ink-on-demand type device hard to achieve.

The inventors have found that a residual charge remains in the dielectric body between the diaphragm and electrode after a pulse voltage is applied between the diaphragm and individual electrodes in ink jet heads using the electrostatic actuator. The field generated by this residual charge decreases the relative displacement of the diaphragm and individual electrodes.

This decrement in the relative displacement is a cause of insufficient ink ejection volume and reduced printing speed, which tends to lead to low print quality. This is evident in character density and pixel shifting, and in lower reliability as evidenced by dropped pixels.

In addition, the magnitude of this residual charge tends to vary due to the hysteresis of past applied voltages. As a result, the relative displacement of the diaphragm and individual electrodes is indefinite and unstable, causing further instability in the ink ejection volume and ejection speed. These factors further contributing to low print quality evident in character density and pixel shifting, and in lower reliability as evidenced by dropped pixels.

These are peculiar problems to the static electricity actuator and piezoelectric device-type heads don't have the mentioned problems.

OBJECTS OF THE INVENTION

Accordingly, it is the object of the present invention to overcome the problems associated with convention ink-on-demand type printer.

It is another object of the present invention to provide an ink-on-demand type printer having an electrostatic actuator.

It is a further object of the present invention to provide an improved method for driving an electrostatic actuator.

It is still another object of the present invention to provide an electrostatic actuator for printing more stability and reliably.

It is still yet another object of the present invention to provide an electrostatic actuator for high-speed printing.

It is still a further object of the present invention is to provide an ink jet head drive method and drive apparatus for eliminating the adverse effects of the diaphragm-electrode residual charge on ink jet head drive, and thereby stabilize the relative displacement of the diaphragm and individual electrodes.

It is still yet another object of the invention is to provide a printing device obtaining good print quality by applying this drive method and drive apparatus.

SUMMARY OF THE INVENTION

In accordance with an aspect of the present invention, a method for recording on a sheet comprises the step of providing a marking fluid jet head formed in a semiconductor substrate having a nozzle, a pathway in communication with the nozzle, and an actuator comprising a diaphragm provided at one part of the pathway, a first electrode provided in opposition to the diaphragm and a second electrode provided on a portion of the diaphragm, the first and second electrodes forming a capacitor A first driving voltage signal is applied to the first and second electrodes to electrostatically attract the diaphragm towards the first electrode in a first direction to fill the pathway with marking fluid. A second driving voltage is applied to the first electrode and the second electrode causing the diaphragm to stabilize and to move in the opposite direction away from the first electrode to thereby eject the marking fluid from the nozzle, the second voltage signal being different from the first.

In accordance with another aspect of the present invention, a method for recording on a sheet comprises the stop of providing a marking fluid jet head formed in a semiconductor substrate having a nozzle, a pathway in communication with the nozzle and a diaphragm provided at one part of the pathway. A capacitor is formed having a first electrode and a second electrode arranged on the diaphragm. A first voltage signal is applied to the capacitor to cause the pathway to fill with marking fluid. A second voltage signal is applied to the capacitor to stabilize it and to eject the marking fluid from the nozzle, the second voltage signal being different from the first.

In accordance with a further aspect of the present invention, a method for recording on a sheet comprises the step of providing a marking fluid jet head formed in a semiconductor substrate having an array of nozzles, corresponding pathways in communication with respective ones of the nozzles and corresponding diaphragms provided at one part of each the pathways. A plurality of capacitors are formed, each corresponding to respective ones of the pathways, each one of the capacitors having a first electrode and a second electrode disposed on a corresponding diaphragm. At least one of the nozzles is selected for printing a pattern by applying a first voltage or charging signal to at least a selected one of the capacitors to fill a respective one of the pathways with marking fluid, and a second voltage signal is applied to the selected ones of the capacitors charged in the previous step to eject marking fluid droplets from the selected nozzles. The previous step is repeated to print successive patterns.

In accordance with still another aspect of the present invention, a recording apparatus comprises a marking fluid head having a nozzle, a pathway in communication with said nozzle, an actuator and a driving circuit. The actuator comprises a diaphragm provided at one part of the pathway, a first electrode provided in opposition to the diaphragm, and a second electrode provided on a portion of the diaphragm. The driving circuit selectively applies a first driving voltage signal to the first and second electrodes to electrostatically attract the diaphragm towards the first electrode in a first direction to fill the pathway with marking fluid, and applies a second voltage signal to the first and second electrodes causing the diaphragm to stabilize and to move in the opposite direction away from the first electrode to thereby eject the marking fluid from said nozzle.

A drive method according to the present invention is applied to printing apparatus that comprises an ink jet head having a nozzle, an ink path in communication with the nozzle, an actuator consisting of a diaphragm provided at one part of the ink path and an electrode provided in opposition to the diaphragm, and a drive means which deforms the diaphragm, thereby ejecting ink droplets from the nozzle to record.

The drive means applies a first voltage to deform the diaphragm during a recording operation, and a secondary voltage, different from the first, to stabilize a displacement of the diaphragm at the prescribed time.

Regarding the first invention, the polarity of the second voltage is opposite from that of the first voltage. The second voltage is applied to the actuator at every printing of a dot or line, or when the nozzle refresh operation is executed, or during initialization of a printing apparatus in which the ink jet head is provided.

A drive device according to the present invention is characterized by a residual charge elimination means which applies the opposite polarity voltage to the actuator. This residual charge elimination means applies an electrical pulse of the opposite polarity voltage to the actuator at every printing of a dot or a line, or when the nozzle refresh operation is executed.

Regarding the second invention, the second voltage is equal to or greater than the maximum voltage of the first voltage applied to the actuator during the printing. The second voltage is applied to the actuator when the nozzle refresh operation is executed, or during initialization of the printing apparatus in which the ink jet head is provided.

An alternative embodiment of an ink jet head drive apparatus according to the present invention is characterized by a power supply voltage means which applies the first voltage to the actuator to deform the diaphragm during ordinary recording, and the secondary voltage to the actuator during the nozzle refresh operation or during initialization of a apparatus in which the ink jet head is provided.

By applying a forward electrical pulse between the diaphragm and individual electrodes of the ink jet head, an electrostatic attraction force is developed between the diaphragm and the individual electrodes provided opposite thereto and this electrostatic force deforms the diaphragm. By then removing or canceling the electrical pulse, ink is ejected from the nozzle by the restoring force of the diaphragm. However, a charge remains between the diaphragm and individual electrodes, even after the electrical pulse is canceled. The field generated by this residual charge prevents the diaphragm from returning completely, and the diaphragm therefore retains some deflection. As described above, the relative displacement of the diaphragm and individual electrodes is reduced in this state.

Regarding the first invention, to prevent this, a voltage with a polarity opposite to the drive voltage polarity is applied before the drive voltage is applied, i.e., before the ink suction operation, to dissipate the residual charge. Deflection of the diaphragm is thus eliminated, and the relative displacement of the diaphragm and individual electrodes does not decrease.

The magnitude of this residual charge also varies due to voltage hysteresis, and is particularly regulated by the maximum applied voltage.

In the second invention, therefore, a maximum voltage that is greater than the drive voltage applied during printing is applied between the diaphragm and electrode to maximize the residual charge and thereby maintain a constant residual charge even when the drive voltage fluctuates up to the maximum voltage during printing. The residual charge field is therefore also constant, and deflection of the diaphragm caused by the residual charge field is constant. As a result, the relative displacement of the diaphragm and individual electrodes during printing is equal to the difference between the deflection caused by the drive voltage and the constant deflection caused by the residual charge of the maximum voltage irrespective of voltage hysteresis, and is unconditionally stable.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference characters denote similar elements throughout the several views:

FIGS. 20A–10F illustrate the change in the deflection of the diaphragm over a period of time in the second embodiment of the present invention;

DESCRIPTION OF THE PREFERRED EMBODIMENTS

The preferred embodiments of the present invention are described below with reference to the accompanying figures.

Figure 2:
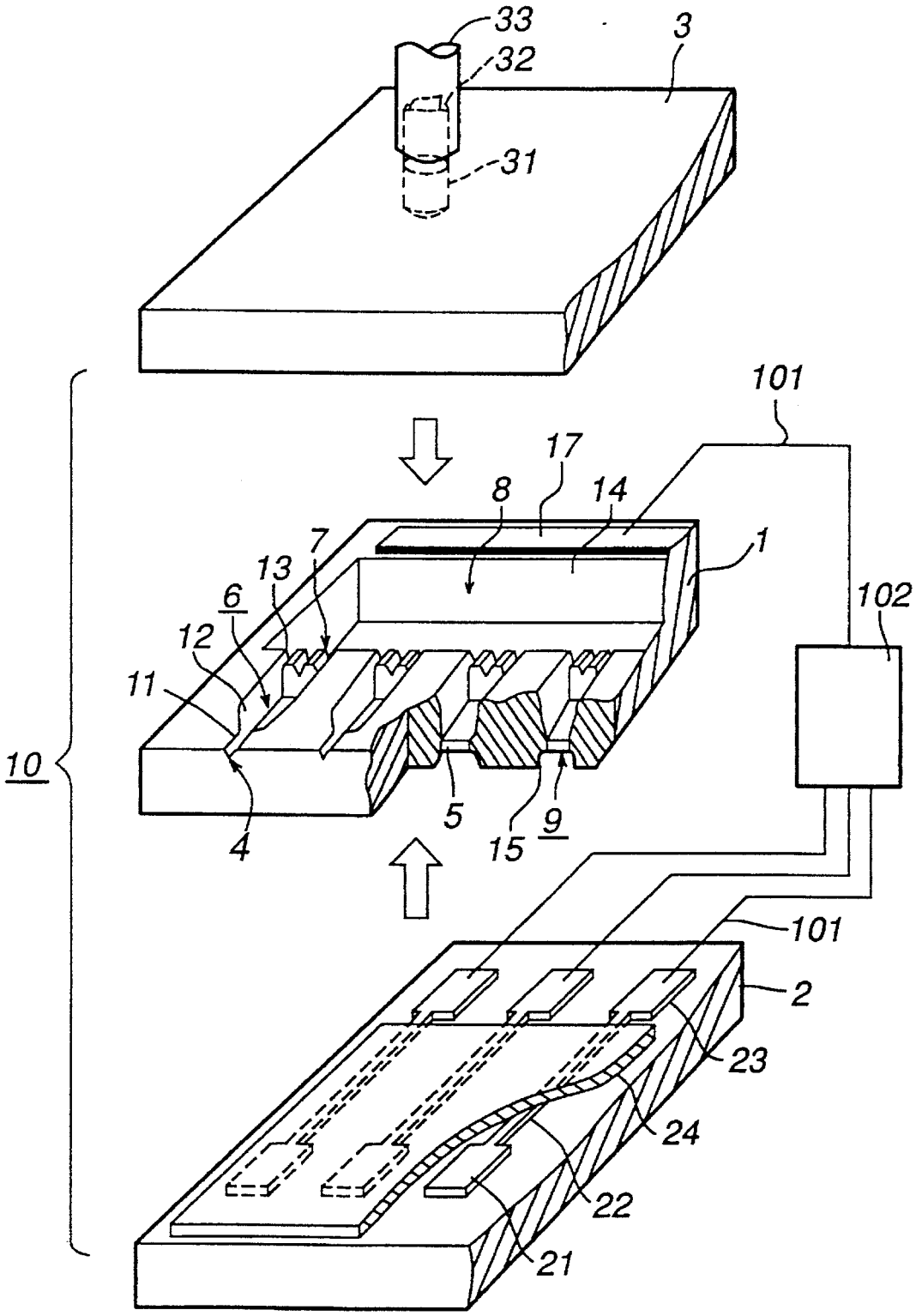
FIG. 2 is an exploded, perspective view of the ink jet head in accordance with the preferred embodiment of the present invention.
Figure 3:
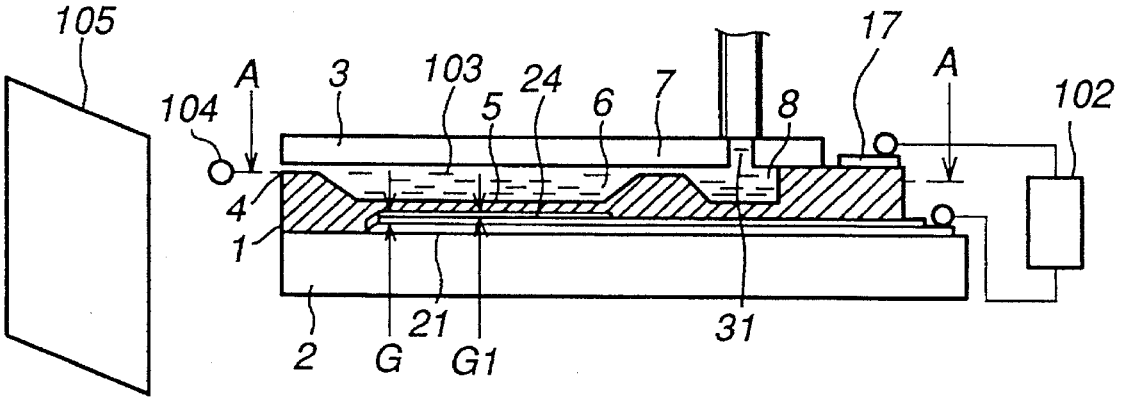
FIG. 3 is a lateral cross-sectional of the ink jet head of FIG. 2.
Figure 4:
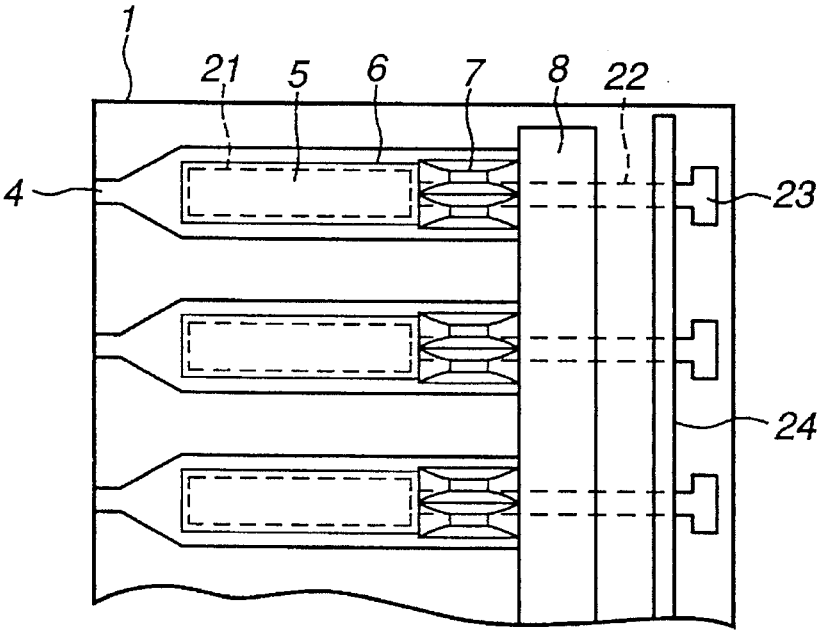
FIG. 4 is a cross-sectional view of the ink jet head taken along line A—A of FIG. 3.

FIG. 2 is a partially exploded perspective view and cross-section of the ink jet head in the preferred embodiment of the invention. Note that while this embodiment is shown as an edge ink jet type whereby ink is ejected from nozzles provided at the edge of the substrate, the invention may also be applied with a face ink jet type whereby the ink is ejected from nozzles provided on the top surface of the substrate. FIG. 3 is a lateral cross-section of the complete assembled apparatus, and FIG. 4 is a cross-sectional view of FIG. 3 taken along line A—A. The ink jet head 10 in this embodiment is a laminated construction of three substrates 1, 2 and 3 that are stacked and joined together as described in detail below.

As shown in FIG. 2 the ink jet head 10 in the preferred embodiment comprises a first substrate 1, arranged between second substrate 2 and third substrate 3. Substrate 1 comprises a silicon substrate. While the presently preferred embodiment employs silicon, as will be appreciated by one of ordinary skill in the art, the present invention is not limited to silicon and any other suitable material may be employed. The surface of this substrate contains nozzle grooves 11 that form nozzles 4 and form parallel, equidistant patterns. A concave section 12, which is connected to or in communication with the nozzle grooves or pathway 11, comprises an ink ejection chamber 6 whose bottom wall is constituted by a diaphragm 5. Narrow grooves 13 provided in the rear portion of concave sections 12 and orifices 7 are fabricated for leading the ink into the ink ejection chamber 6. A concave section 14, which comprises a common ink cavity 8, supplies a marking fluid such as ink to each of the ink ejection chambers 6. It will be appreciated that marking fluid includes any fluid used for recording on a recording sheet. In the lower portion of the diaphragm 5, a concave section 15 is provided which forms vibration chamber 9 when the second substrate 2 is joined, as described hereinbelow.

Referring to FIGS. 3 and 4, the opposing interval between diaphragm 5 and oppositely placed individual electrode 21, i.e., the length G of a gap section 16 (hereinafter "electric gap length"), can be obtained as the difference between the depth of concave section 15 and the thickness of electrode 21. In this embodiment, concave section 15 of vibration chamber 6, that serves as an interval retention or gap holding means for defining the electric gap length, is formed on the back of first substrate 1. In another example, the concave section may be formed on the top surface of second substrate 2 (not shown). In the present embodiment, the depth of concave section 15 is preferably defined as 0.6 μm through etching. It should be noted that the pitch of nozzle groove 11 is 0.72 μm, having a width of 70 μm.

In this embodiment, a common electrode 17, which is provided in the first substrate 1, is made of either platinum with a titanium base or gold with a chromium base. The selection of these materials takes into consideration the magnitudes of the work functions of first substrate I as a semiconductor and metal for the common electrode. In the preferred embodiment, the magnitude of the work function of the semiconductor and the metal used for the electrodes is an important factor determining the effect of common electrode 17 on first substrate 1. The semiconductor material used in this embodiment therefore has a sheet resistance of 8–12 Ωcm, and the common electrode is made from platinum with a titanium backing or gold with a chrome backing. The present invention shall not be so limited, however, and various other material combinations may be used according to the characteristics of the semiconductor and electrode materials. Obviously, other electrode formation techniques that are known can also be employed.

In the preferred embodiment, a boron silicate-based glass, such as Pyrex® glass, is used as second substrate 2. Second substrate 2 is then joined to the underside of first substrate I in order to form a vibration chamber 9. Gold is then sputtered to a thickness of 0.1 μm on the corresponding sections of the second substrate to diaphragm 5, thus forming individual electrodes 21. Thus electrodes 21 are made of gold and have substantially the same shape as diaphragms 5. Individual electrodes 21 are provided with corresponding leads 22 and terminals 23. Further, the entire surface of the second substrate 2 except for the electrode terminals 23 is coated with boron silicate-based glass, to a thickness of 0.2 μm in order to form an insulator 24 by using the sputter method. Preferably a 0.2 μm thick insulation layer 24 for preventing dielectric breakdown and shorting during ink jet head drive is formed from a Pyrex® sputter film on second substrate 2 but not over terminal members 23. The film thus formed prevents insulation breakdown and shorting during the operation of the ink jet head. Second substrate 2 is then joined to the underside of the first substrate forming the vibration chamber 9.

Third substrate 3, which is joined to the top surface of the first substrate 1 by known techniques is made of a boron silicate-based glass similar to second substrate 2. Joining third substrate 3 to the first substrate forms nozzle holes 4, ink ejection chamber 6, orifice 7, and ink cavity 8. Third substrate 3 is provided with an ink supply inlet or port 31 in communication with ink cavity 8. Ink supply inlet 31 is connected to the ink tank or reservoir (not shown in the figures) through a connecting pipe 32 and a tube 33.

As a next step, first substrate I and second substrate 2 are bonded by using the anodic-bonding method through the application of a 300° C.–500° C. temperature and a 500–800 V. Likewise, first substrate I and third substrate 3 are joined under similar conditions in order to assemble the ink jet head, as shown in FIG. 3. The electric gap length G, which is formed between individual electrodes 21 that are formed on second substrate and each corresponding diaphragm 5 upon completion of the anodic-bonding process, is equal to the difference between the depth of concave section 15 and the thickness of individual electrode 21. In the preferred embodiment, this value is defined as 0.5 μm. Likewise, the mechanical gap length, G1, formed between diaphragm 5 and insulator 24, that covers the individual electrodes 21, is 0.3 μm.

To drive the ink jet head having the above configuration conductors or wires 101 are used to electrically connect a drive circuit or electrostatic actuator driver 102 to common electrode 17 and to terminal sections 23 of respective individual electrodes 21. The detailed operation and construction of drive circuit 102 will be discussed hereinbelow. Ink 103 is supplied from an ink tank (not shown) through ink supply inlet 31 and fills the ink channel or pathways, such as ink cavity 8, and ink ejection chamber 6. When ink jet head 10 is operated, ink in the ink ejection chamber 6 is then transformed into ink droplets by nozzle holes 4 and ejected, as shown in FIG. 3 for recording or printing on the recording paper 105.

Figure 5:
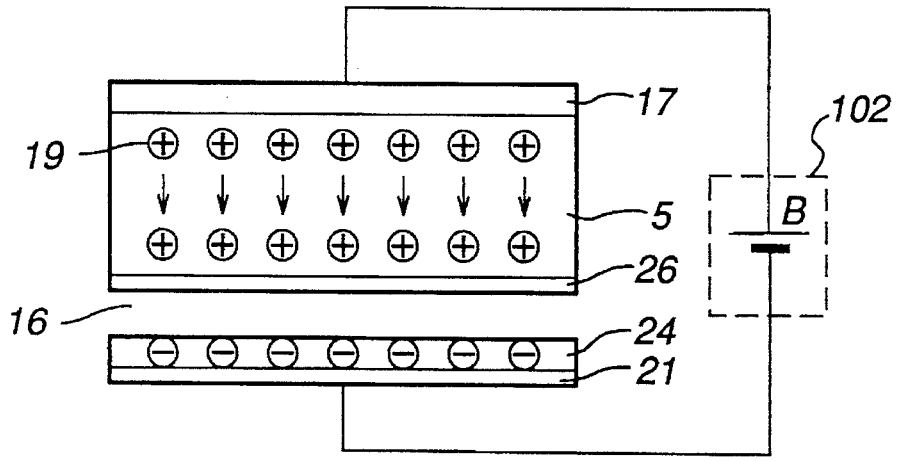
FIG. 5 is a simulated view of the diaphragm and individual electrode charge states in the preferred embodiment of the present invention.

FIG. 5 is a simulated view of the diaphragm and individual electrode charge states in the preferred embodiment. In this embodiment, a p-type silicon is used as a first substrate 1. The first substrate 1 diaphragm 5, i.e., common electrode 17 is connected to drive circuit 102 so that a positive charge is applied to it and the individual electrodes 21 side is connected to drive circuit 102 so that a negative charge is applied to them. Drive circuit 102 comprises a power supply, such as a DC voltage source. A pulse voltage is applied by drive circuit 102 to common electrode 17 and individual electrodes 21. The p-type silicon is doped with boron and has electron holes equal to a number of doped boron, because of the electron deficiency equal to a number of doped boron. The positive charge in the common electrode 17 causes electron holes 19 in the p-type silicon to repel towards insulation layer 26. As a result of this electron hole 19 movement, a space-charge layer does not exist in first substrate 1. This is a result of the positive charge being supplied to an acceptor, in this case ionized boron, from common electrode 17 which produces a current of electron holes in first substrate 1, and thus functions as a conductor. In addition, a negative charge is applied to the individual electrodes 21 side. As a result, the applied pulse voltage generates an attractive force, due to static electricity, sufficient to deflect diaphragm 5. As a result, diaphragm 5 is deflected towards individual electrodes 21.

Figure 6:
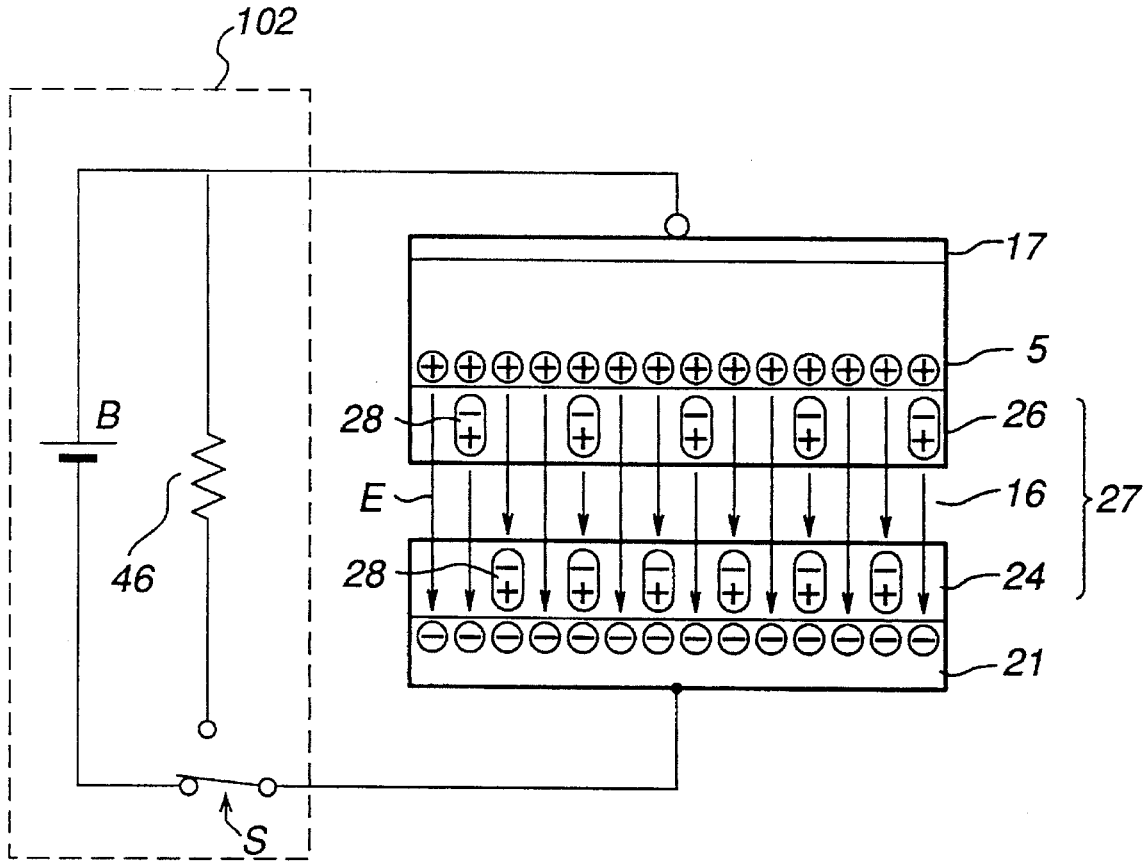
FIG. 6 is a simulated view of the polarization states of the diaphragm and individual electrode charge states shown in FIG. 5.
Figure 7:
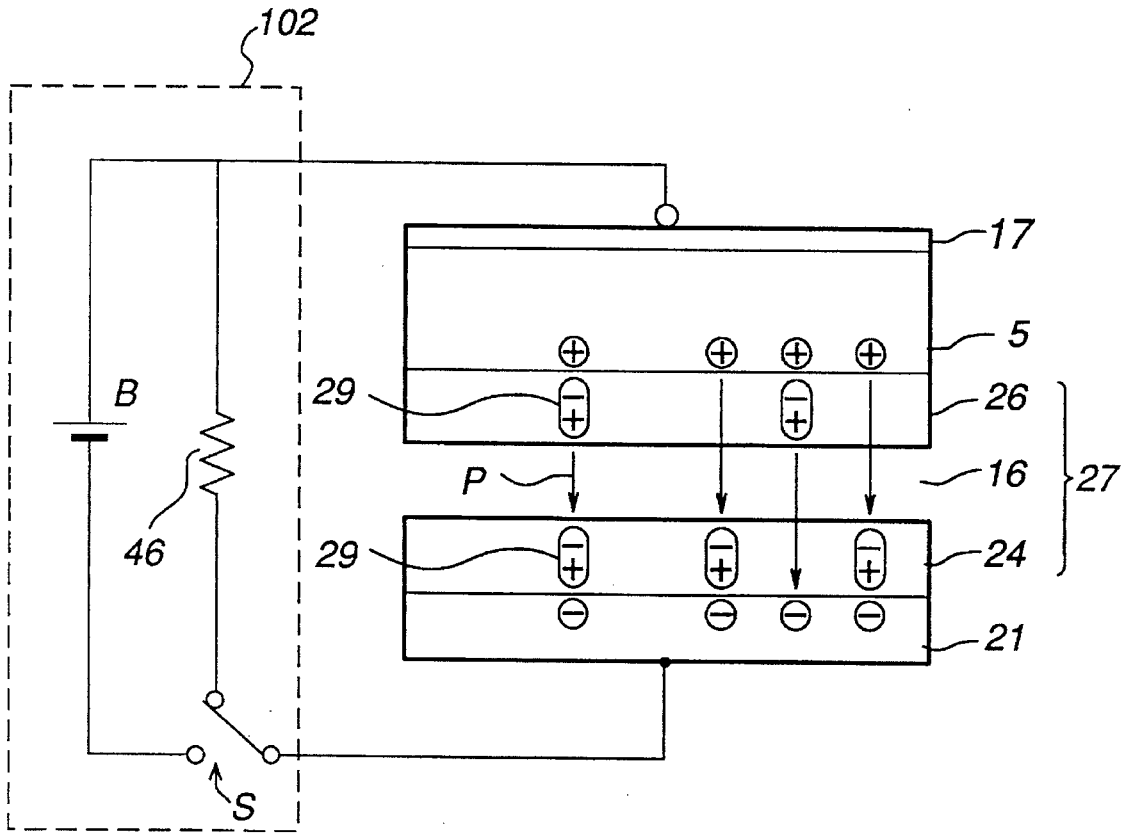
FIG. 7 is a simulated view of the residual charge states of the diaphragm and individual electrode charge states shown in FIG. 5.

FIGS. 6 and 7 illustrate the residual charge of the dielectric between the diaphragm and individual electrodes. As shown in those figures, drive circuit 102 further comprises a resistance 46 and a selection circuit or switch S. FIG. 6 shows the state when a charging voltage is applied and the capacitor consisting of diaphragm 5 and individual electrodes 21, and FIG. 7 shows the state when this voltage is eliminated and the capacitor is discharged through resistance 46. The occurrence of this residual charge is described below with reference to FIGS. 6 and 7. In both FIGS. 6 and 7, diaphragm 5 is made from a semiconductor and common electrode 17 is the above mentioned metal forming an ohmic contact with the semiconductor, and diaphragm 5 is coated by insulation layer 26, such as, an oxide silicon layer. Insulation layer 24 formed on individual electrodes 21 is arranged opposite and facing insulation layer 26 across gap 16, and insulation layer 26, gap 16, and insulation layer 24 together form insulation layer 27. As a result, a dielectric body is effectively formed inside the parallel fiat capacitor formed by diaphragm 5 and individual electrodes 21.

As shown in FIG. 6, when a voltage is applied to the parallel fiat capacitor, the dielectric body produces polarization 28 in the direction canceling the field E generated by the applied voltage or the direction opposite the field. Most of polarization 28 dissipates through resistance 46 in a relatively short time when the charging state is switched to the discharging state by switch S.

The delay time from discharging the capacitor and eliminating the field E to dissipation of polarization is called the relaxation time, and varies greatly with the type of polarization.

When the dielectric body, i.e., insulation layer in diaphragm 5 and individual electrodes 21 of the preferred embodiment is polarized, polarization components known, for example, as ion polarization and interfacial polarization, and having a relatively long polarization relaxation time are contained in addition to short relaxation time atomic polarization and electron polarization. Ion polarization occurs as a result of Na+, K+, and/or B+ in the insulation layer traveling along the generated field; interfacial polarization occurs from movement at the crystal interface within the dielectric.

Thus, part of the polarization remains as a result of repeated voltage application or extended continuous application, and the dielectric body (24, 26) in diaphragm 5, and individual electrodes 21 of the embodiment retains partial polarization for an extended period as shown in FIG. 7. The dielectric body thus effectively contains residual polarization 29, and the residual field P produced by the charge remaining between diaphragm 5 and individual electrodes 21 invites reduced relative displacement of diaphragm 5 and individual electrodes 21.

Figure 8:
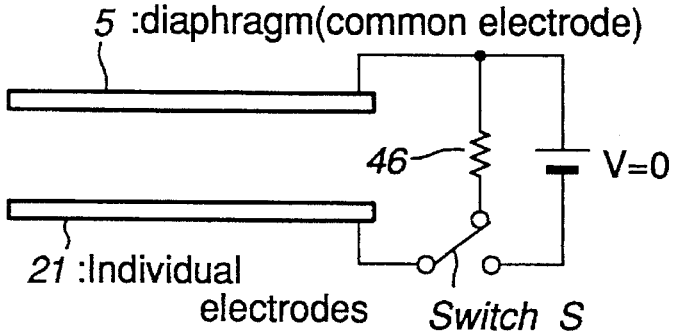
FIGS. 8A–8C illustrate the change in the deflection of the diaphragm over a period of time in the first embodiment of the present invention.
Figure 8:
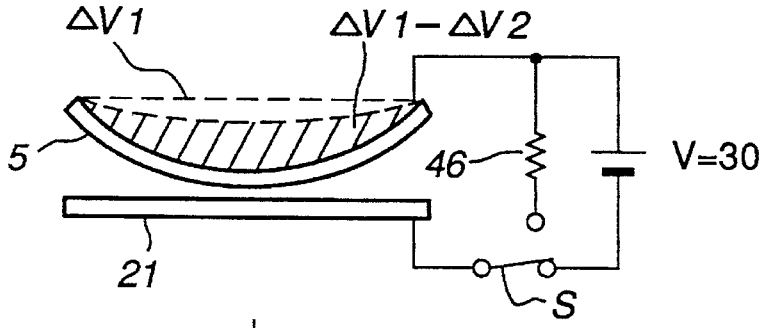
Figure 8:
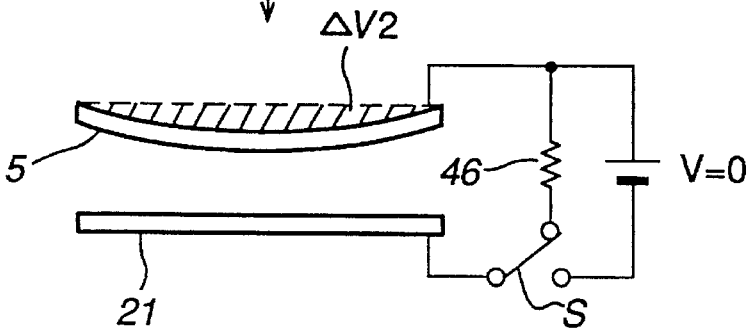

FIGS. 8(*a*)–8(*c*) show the change, over time, in deflection of the diaphragm and individual electrodes. FIG. 8(*a*) shows the state when there is no voltage applied to the capacitor consisting of diaphragm 5 and individual electrodes 21. As shown in the figure, diaphragm 5 and individual electrodes 21 are positioned substantially parallel to each other. FIG. 8(*b*) shows a state when a voltage is applied to the capacitor. In other words, the capacitor is charged by applying a voltage. As shown therein, diaphragm 5 deflects towards electrode 21 by an amount $\Delta V1$. FIG. 8(*c*) shows the state after the capacitor is discharged through resistance 46. Even after the capacitor is discharged, diaphragm 5 remains deflected by the residual field generated by the residual charge. This residual deflection is defined as $\Delta V2$, as explained below. When a charging voltage is reapplied to diaphragm 5 and individual electrode 21, the relative displacement is now $\Delta V1-\Delta V2$, due to the residual deflection. That is, there is a drop or decrease in relative displacement.

As described above, this decreased relative displacement of diaphragm 5 and individual electrodes 21 is a cause of reduced ink ejection volume, ink speed, and other ink eject-related defects. This characteristic, as noted above, adversely affects ink jet printer reliability and print quality. To solve this problem, a voltage opposite that shown in FIG. 6 is therefore applied between diaphragm 5 and individual electrodes 21 to cancel the residual charge. This driving method is described and explained in detail hereinbelow.

Figure 1:
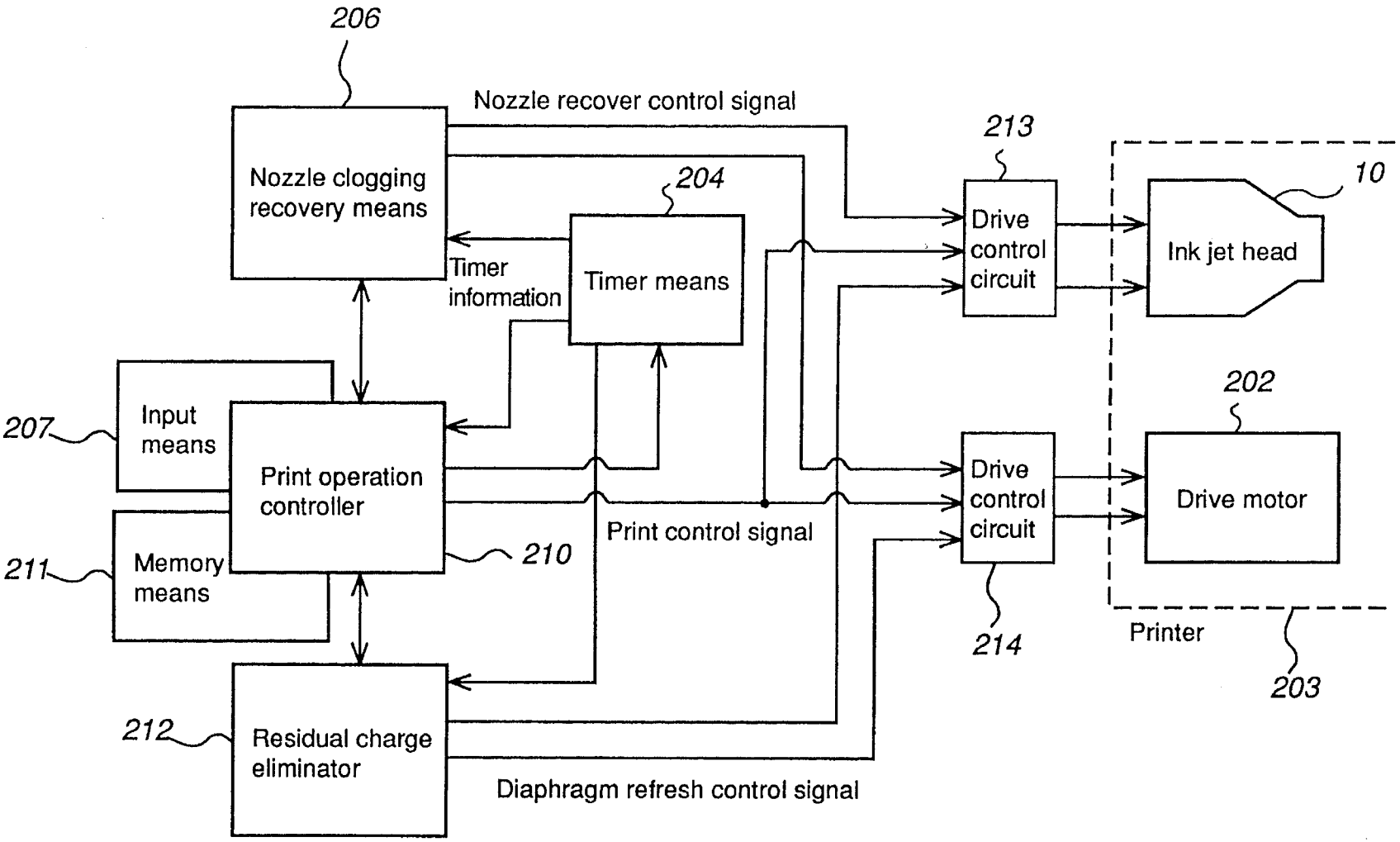
FIG. 1 is a block diagram of a printer comprising an ink jet head according to a first embodiment of the invention.

FIG. 1 is a block diagram of an ink jet printer according to the preferred embodiment of the invention. As shown in the figure, the primary components of this ink jet printer 203 are drive motor 202 for moving the ink jet head and, a recording sheet, paper or other printed medium, and ink jet head 10. This ink jet printer 203 prints text and/or graphic elements by ejecting a marking fluid, for example, ink to the paper or print medium from ink jet head 10 while moving ink jet head 10 and the print medium by means of drive motor 202.

Referring again to FIG. 1, timer means 204 counts the time, and nozzle dogging recovery means 206 controls the process for recovering from nozzle dogging. Print operation controller 210 controls printing and the various operations executed on the input signal from input means 207, and outputs the initialization signal for starting timer means 204 and print control signals controlling ink jet printer 203. Print operation controller 210 may be implemented as a microprocessor. Of course, as would be understood by those of ordinary skill in the art, controller 210 may be implemented by other suitable circuitry. The data used in the operations executed by print operation controller 210 are stored in storage or memory means 211. Memory means 211 can comprise, for example, any type of solid state, magneto-optical or magnetic memory. Residual charge eliminator 212 for the diaphragm outputs the diaphragm refresh control signal for the refresh process of the residual charge in the diaphragm as described below.

Figure 9:
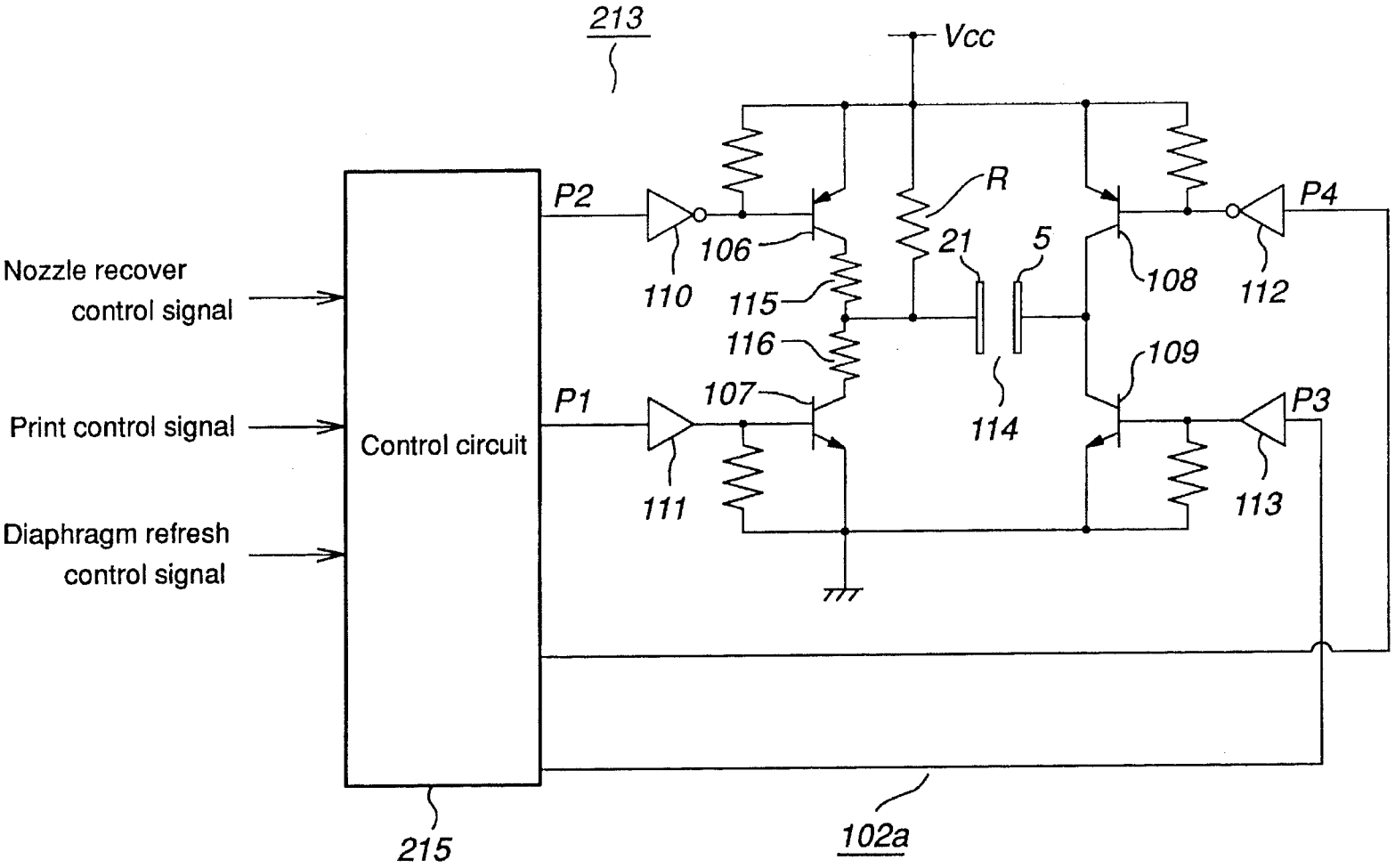
FIG. 9 is a schematic diagram of the drive control circuit for the ink jet head of the preferred embodiment of the present invention.

The configuration of drive control circuit 213 for ink jet head 10 is shown in FIG. 9. While the circuit of FIG. 9 is preferred, persons of ordinary skill in the art who have read this description will recognize that various modifications and changes may be made therein. The nozzle refresh control signal, print control signal, and diaphragm refresh control signal are input to drive control circuit 213, which controls ink jet head 10 based on these input control signals. The nozzle refresh control signal, print control signal, and diaphragm refresh control signal are also input to drive control circuit 214 of drive motor 202, and drive control circuit 214 similarly controls driving drive motor 202 based on these input control signals.

FIG. 9 is a schematic diagram of the drive control circuit for ink jet head 10. As shown in the figure, drive control circuit 213 comprises control circuit 215 and drive circuit 102*a*. Drive circuit 102(*a*) preferably comprises transistors 106–109, and amplifiers 110–113. As shown therein, amplifiers 110 and 112 are inverting amplifiers. It will be appreciated by one of ordinary skill in the art that driver circuit 102*a* may be implemented by other suitable circuit arrangements. The nozzle refresh control signal, print control signal, and diaphragm refresh control signal are input to control circuit 215, which generates and outputs appropriate pulse voltages P1–P4 for output to amplifiers 110–113 based on the input control signals. Transistors 106–109 are driven by the outputs from amplifiers 110–113, thus charging and discharging the capacitor 114 formed by diaphragm 5 and individual electrodes 21 to emit ink drop 104 from nozzle 4. A detailed description of the operation of drive circuit 102*a* is presented hereinbelow. By appropriately selecting the resistance value of resistor 115 and 116 desired charge/discharge characteristics may be obtained with a relatively slow charge speed and a fast discharge speed. The charging speed or rate is substantially determined by the time constant formed by the value of capacitance 114 and resistance 115. Similarly, the discharging rate is substantially determined by the time constant of capacitance C and resistance 116.

Figure 10:
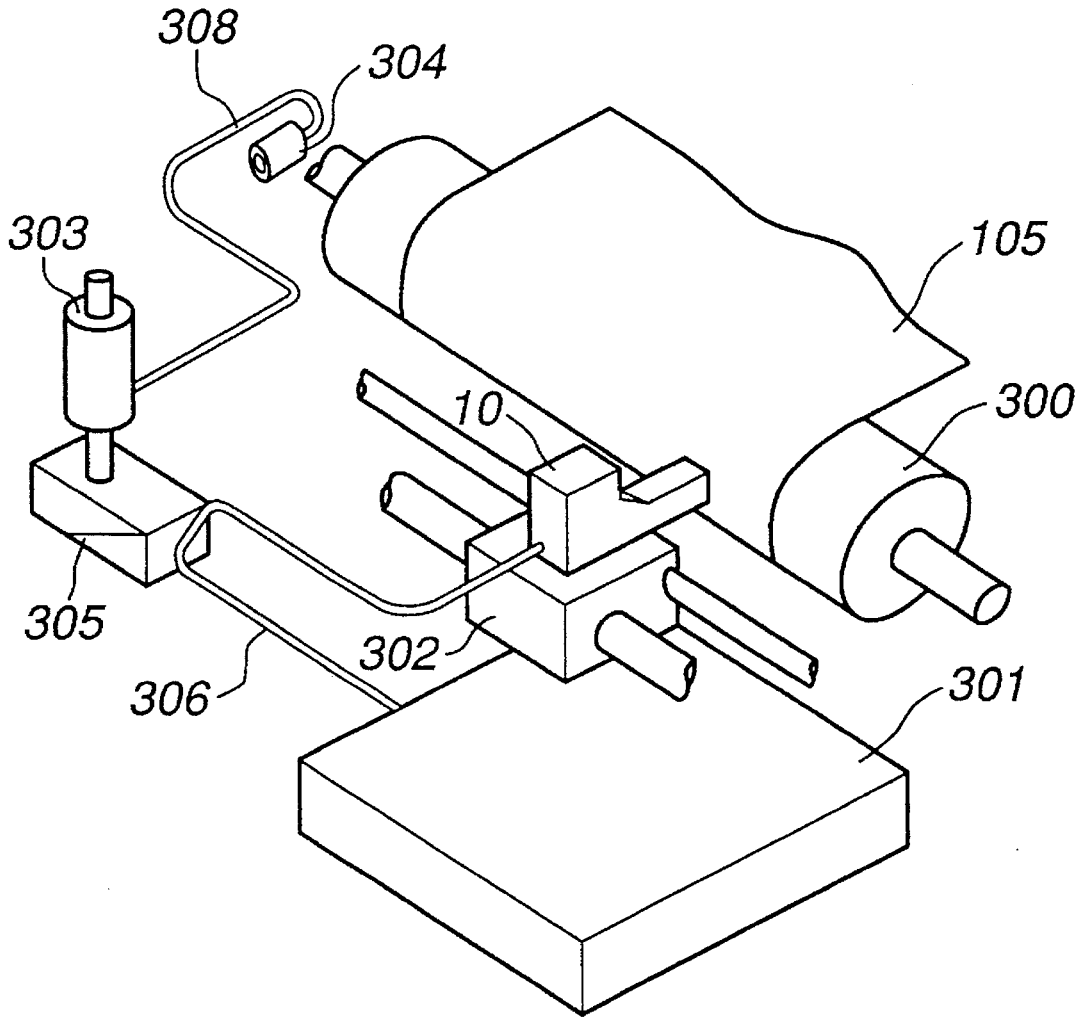
FIG. 10 is a conceptual diagram of a printer having an ink jet head in accordance with the preferred embodiment of the present invention.

FIG. 10 shows an overview of an exemplary printer that incorporates the ink jet head 10 described above. Of course, as will be appreciated by one of ordinary skill in the art, various other types of printers may employ the ink jet head in accordance with the present invention. A platen 300 or paper transport means feeds recording sheet or paper 105 through the printer. Ink tank 301 stores ink therein and supplies ink to ink jet head 10 through ink supply tube 306. Ink jet head 10 is mounted on carriage 302 and is moved parallel to platen 301 by carriage drive means 310, preferably comprising a stepping motor, in a direction perpendicular to the direction in which recording paper 105 is transported. Ink is discharged appropriately from a row of nozzles in synchronization with the transfer of the ink jet head so as to print, for example, characters and graphics on recording paper 105. Because it is desirable to provide the drive circuit as close to the ink jet head as possible, the drive circuit is incorporated into ink jet head 10. In other embodiments the drive circuit may be separated and mounted on carriage 302. As shown in FIG. 33, a device is provided for preventing the clogging of the ink jet head nozzle, a problem peculiar to printers that incorporate on-demand-type ink jet heads. To prevent the clogging of the nozzle for the ink jet head 10 the ink jet head is positioned opposite cap 304, for discharging ink tens of times. Pump 303 is used to suction ink through the cap 304 and the waste ink recovery tube 308 for recovery in waste ink reservoir 305.

Figure 11:
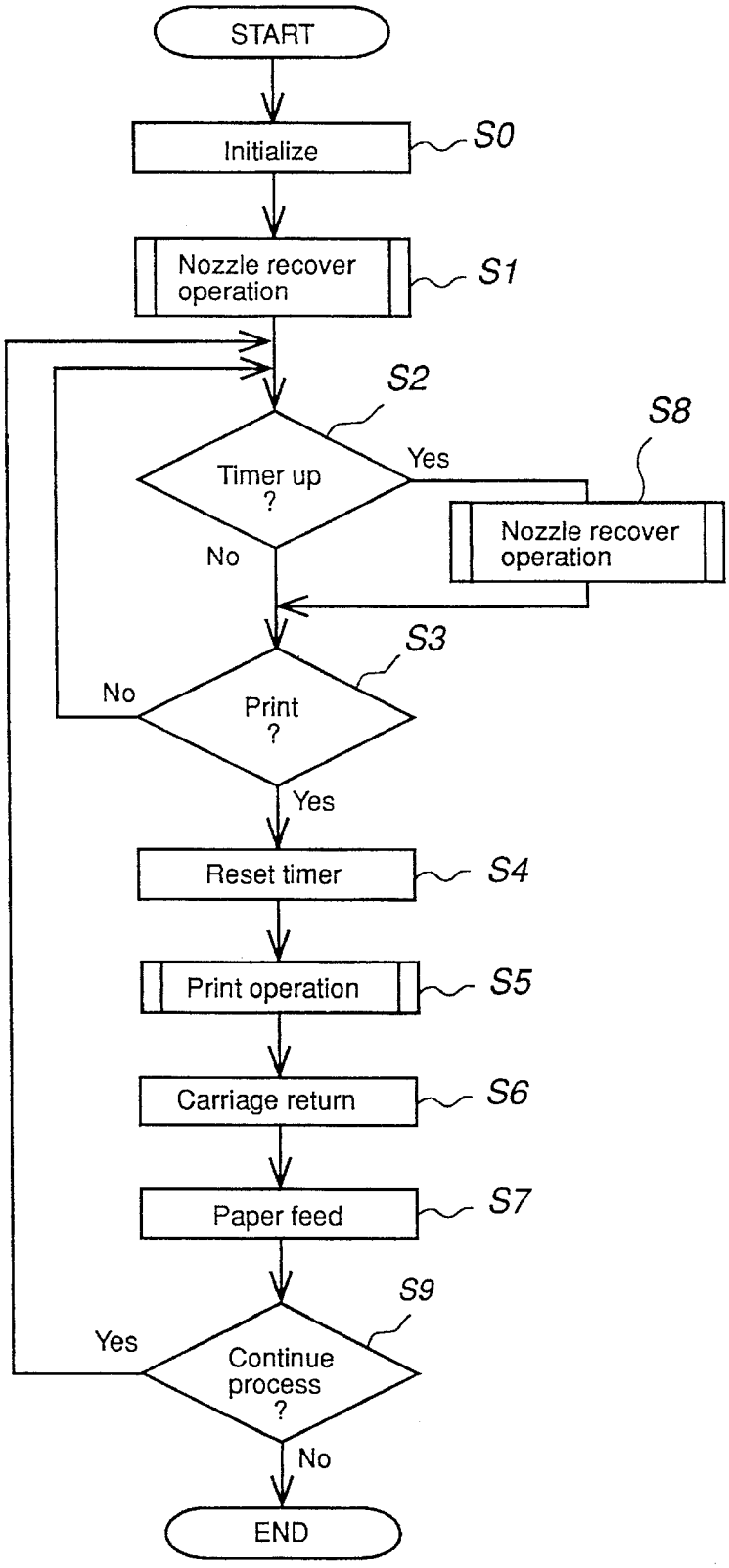
FIG. 11 is a flow chart of a first control method of an ink jet printer of the first embodiment of the present invention.
Figure 12:
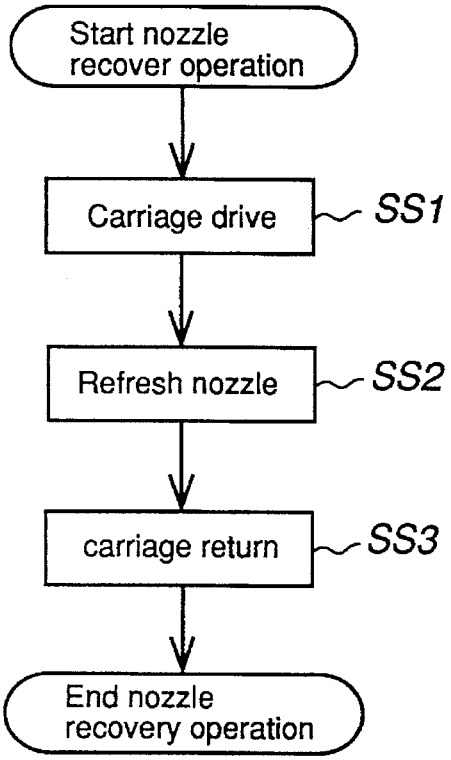
FIGS. 12(*a*) and 12(*b*) are a flow charts of the subroutines of the control method shown in FIG. 11.
Figure 12:
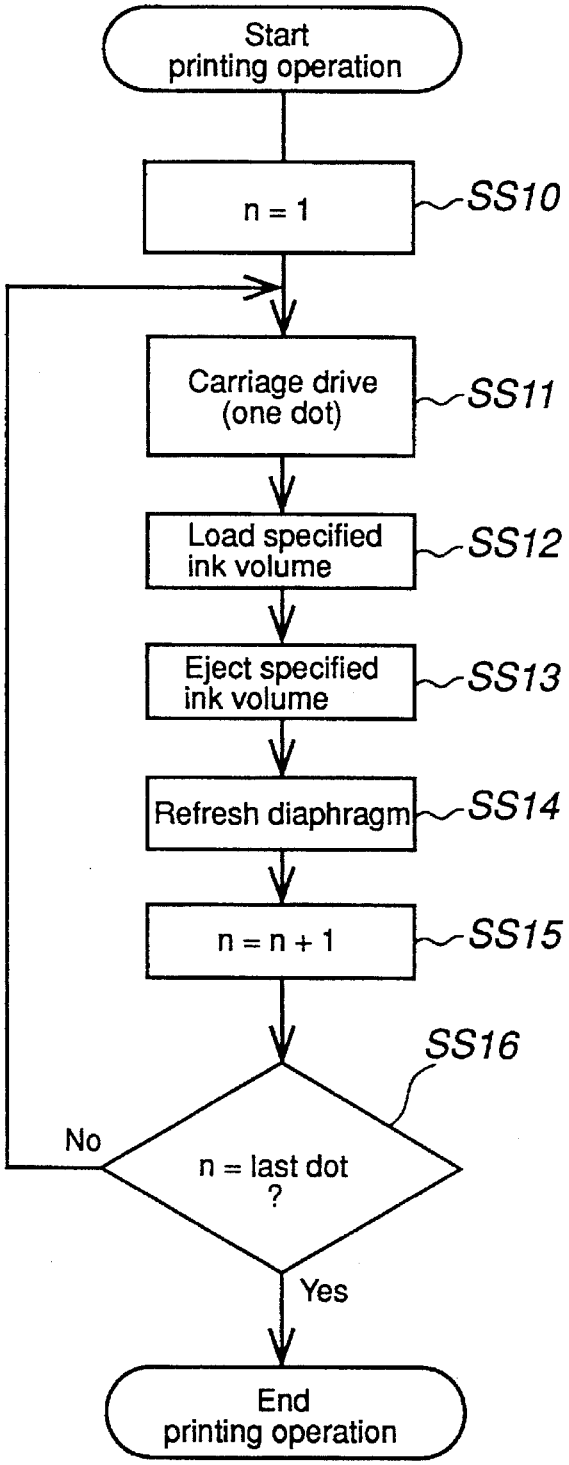

FIG. 11 is a flow chart of the ink jet printer control method according to the preferred embodiment of the invention shown in FIG. 1. FIGS. 12(*a*) and 12(*b*) are flow charts of two subroutines shown in FIG. 11, FIG. 12(*a*) being the nozzle refresh operation subroutine and FIG. 12(*b*) the print operation subroutine.

Referring specifically to FIG. 11, the first step S0 is to initialize the printer mechanisms based on the control signals output from print operation controller 210. For example, as a result of the initialization, the carriage is located at a home position. Timer means 204 is simultaneously reset and begins the timing count. At step S1, the nozzle refresh operation is executed immediately after the power is turned on. This nozzle refresh operation executes steps SS1–SS3 in the nozzle refresh operation subroutine shown in FIG. 12(*a*), and is described below.

Turning to FIG. 12(*a*) at step SS1, carriage 302 carrying ink jet head 10 is moved from a standby position to a position facing cap 304 by driving drive motor 202. At step SS2, the nozzle refresh operation is executed. This nozzle refresh operation drives diaphragm 5 for all of the nozzles to eject a predetermined amount of ink from all nozzles to remove dried, concentrated or high viscosity ink, which can cause ink eject defects, from the nozzles of ink jet head 10. Anywhere from approximately 10–200 ink drops are normally ejected from each nozzle to expel any residual ink from the nozzles. The number of times this refresh operation is executed is determined by the time setting of timer means 204. After the nozzle refresh operation is completed, carriage 302 is again returned to the standby position, step SS3, to complete the nozzle refresh operation.

Note that, in general, if the ink jet head has not been used for an extended period of time when the power is first turned on, ink is therefore expelled from the nozzles approximately 160–200 times.

When the nozzle refresh operation is completed, timer means 204 begins counting a predetermined time. A timer up signal is checked at step S2 to determine whether timer means 204 has counted the predetermined time. If the timer up signal is detected, the procedure continues to the nozzle refresh operation step S8. The nozzle refresh operation shown in the FIG. 12(*a*) subroutine is again executed, and the procedure then advances to step S3. If, however, the timer up signal is not detected, the procedure proceeds directly to step S3.

At step S3 it is determined whether to proceed with printing. If printing is not required, the procedure loops back to step S2. If printing is required, timer means 204 is reset in step S4, and the printing operation is executed in step S5.

This printing operation is controlled by the subroutine of steps SS10–SS16 shown in FIG. 12(*b*).

At step SS10 the count n is reset to 1, and carriage 302 is moved one dot, step SS11. In steps SS12 and SS13, the ink is suctioned and ejected at the specified dot based on printing data. After that, the diaphragm 5 refresh or residual charge elimination operation is executed in step SS14. At this point, the count n is incremented to n+1. In step SS16 it is determined if count n is equal to the last dot count. If n does not equal the last dot, the procedure loops back to step SS11, and steps SS11–SS16 are then repeated. Note that, the diaphragm 5 refresh operation in step SS14 is executed for only the specified diaphragms which were driven in steps SS12 and SS13.

If n equals the last dot, the procedure exits the subroutine and advances to step S6, at which point carriage 302 is returned to the standby position, and the paper is then advanced a predetermined distance in step S7. Whether the process is to continue is evaluated in step S9; if printing is not completed, the procedure loops back to step S2 and the above operation is repeated. If printing is completed, the procedure terminates.

Figure 13:
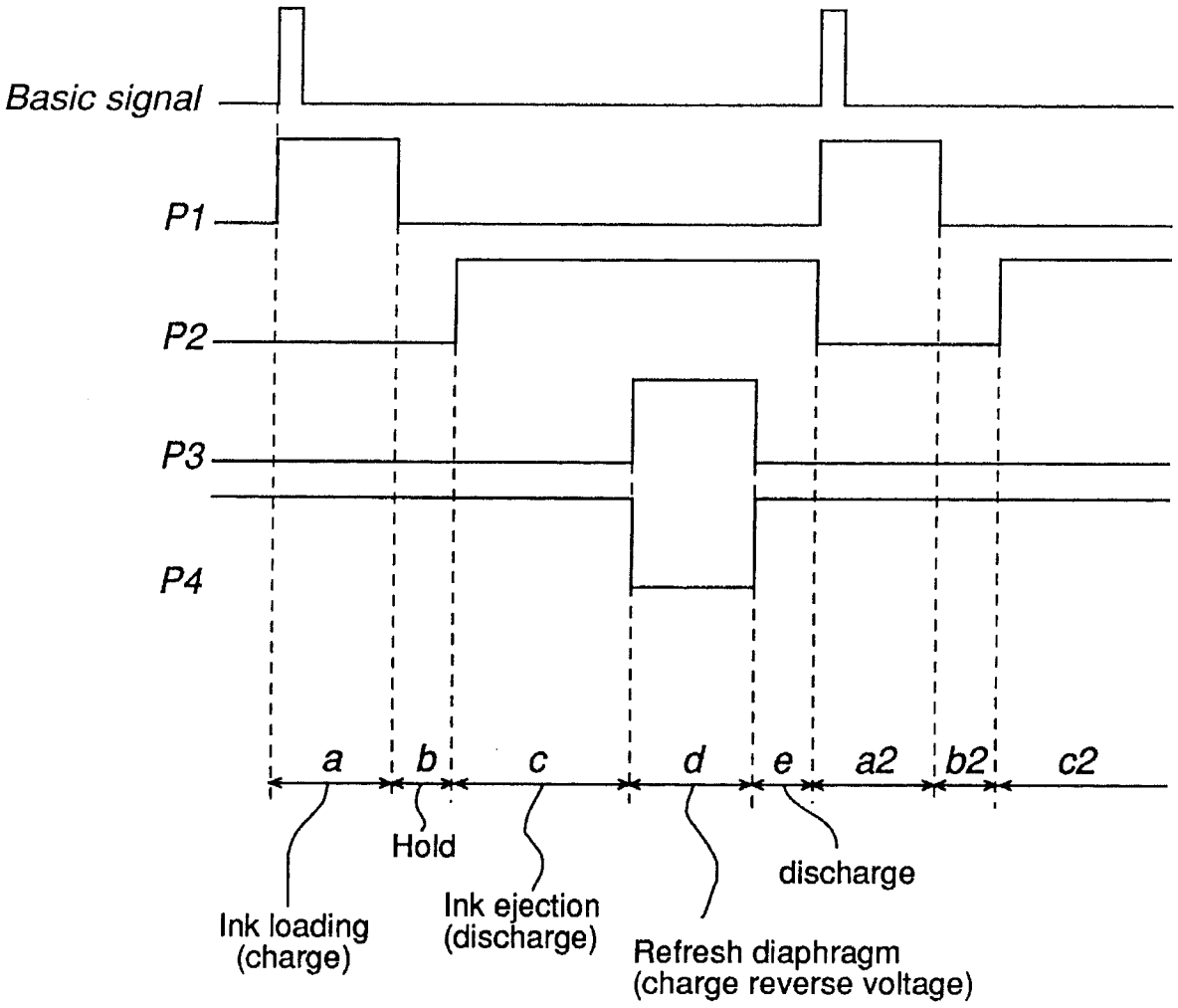
FIG. 13 is a timing chart of the operation of the first control method of FIG. 11.

FIG. 13 is a timing chart of the operation of the embodiment illustrated in FIGS. 9 and 12. It is assumed here that pulse voltage P4 is applied and transistor 108 is 0N in the standby position thereby keeping the capacitor 114 discharged via a resistance R. Initially, pulse voltages P1 and P4 are applied, transistors 108 and 107 turn ON, and positive and negative voltages, respectively, are applied to diaphragm 5 and individual electrodes 21 during period a. This causes a forward charge to accumulate in capacitor 114. Diaphragm 5 thus deflects to individual electrodes 21 due the resulting electrostatic attraction force, the pressure inside jet chamber 6 drops, and ink 103 is supplied from ink cavity 8 through orifice 7 to jet chamber 6.

After waiting for hold period b, or a period when only pulse P4 is applied, pulse voltages P2 and P4 are applied. As a result, transistors 106 and 108 become ON, and the charge stored in capacitor 114 is rapidly discharged. The electrostatic attraction force acting between diaphragm 5 and individual electrodes 21 thus dissipates, and diaphragm 5, returns to its former undeflected position due to its inherent rigidity. Return of diaphragm 5 rapidly increases the pressure inside jet chamber 6, causing ink drop 104 to be ejected from nozzle 4 toward recording paper 105. As indicated in period d, diaphragm 5 is then refreshed thereby pulse voltages P2 and P3 are supplied, transistors 106 and 109 become ON, and negative and positive voltages, respectively, are applied to diaphragm 5 and individual electrodes 21. Note that these voltages are opposite the voltages applied during the normal printing operation, and are opposite the charge voltages. As a result, the residual charge, as shown FIG. 7 dissipates. Diaphragm 5 is not in deflect position as shown in FIG. 8(*c*) which is typical for conventional devices. Instead diaphragm 5 is fully restored by discharging the capacitor during period e because the residual charge has been completely dissipated by previous application of the reverse voltage as described above. Thus, an ink ejection volume which is ejected at next period c2 and that at previous period c are the same. As thus described, the residual charge created between diaphragm 5 and individual electrodes 21 is discharged each dot while outputting ink drop 104.

It is to be noted that while a reverse voltage is applied in the preferred embodiment above to eliminate the residual charge, the reverse voltage will also deflect diaphragm 5, and it is necessary to prevent ink ejecting at this time. When a semiconductor is used for diaphragm 5, there is minimal deflection even when the reverse voltage equals the forward voltage, and there is thus no danger of ink being emitted by reverse voltage application. It is therefore possible to use a common power supply in this embodiment. When a conductor is used for diaphragm 5, however, ink may be ejected if the reverse voltage equals the forward voltage, and it is therefore necessary to reduce the reverse voltage.

Note also that a p-type semiconductor is used for the semiconductor substrate in this embodiment, but as will be appreciated by those of ordinary skill in the art, an n-type semiconductor can be alternatively used. In this case, the connections between drive circuit 102*a* and ink jet head 10 must be reversed from those used with a p-type semiconductor.

Figure 14:
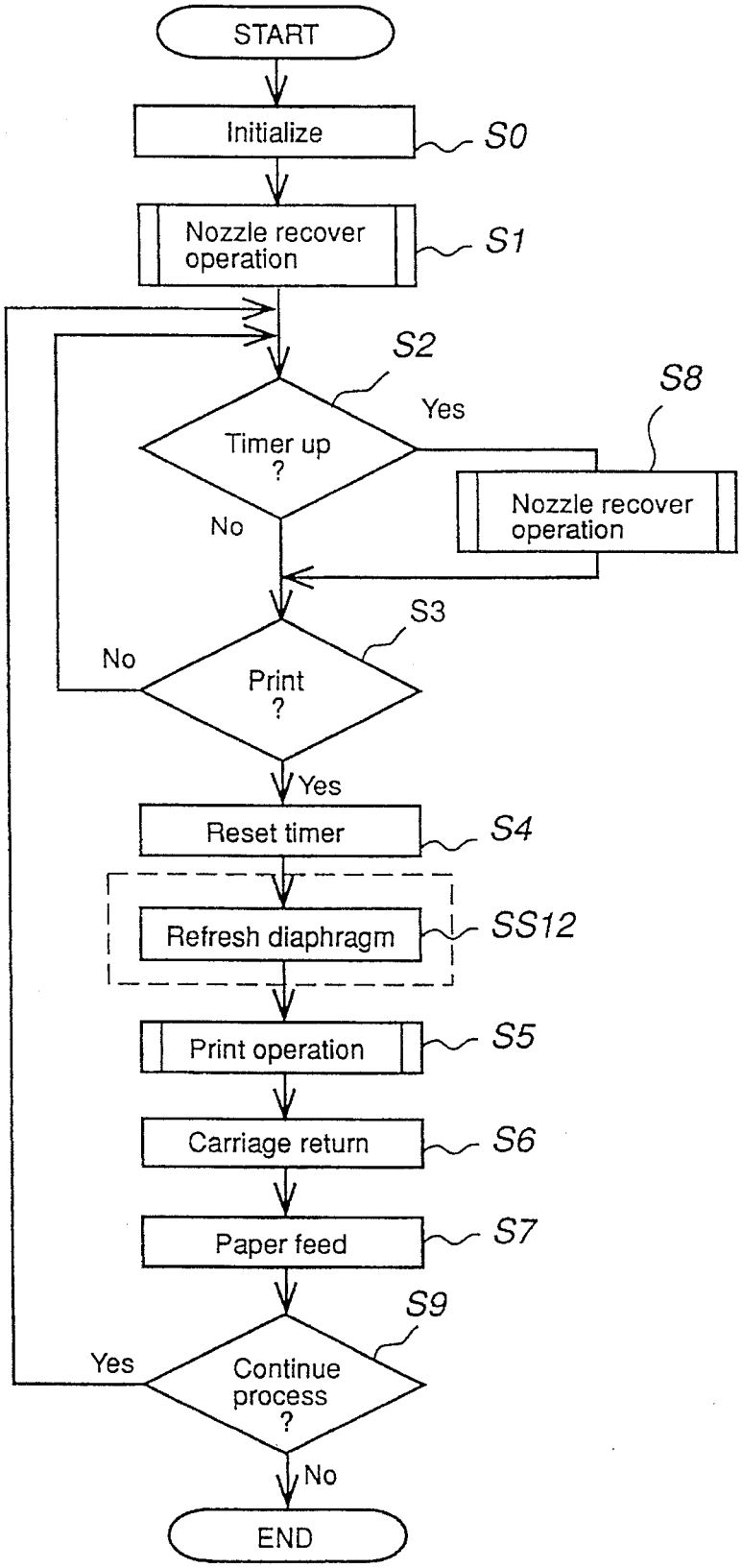
FIG. 14 is a flow chart of a second control method of an ink jet printer of the first embodiment of the present invention.
Figure 15:
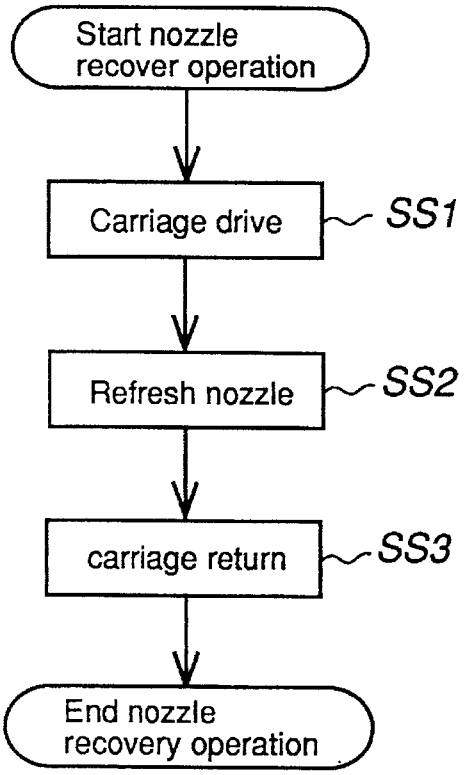
FIGS. 15(*a*) and 15(*b*) are flow charts of the subroutines of the second control method shown in FIG. 14.
Figure 15:
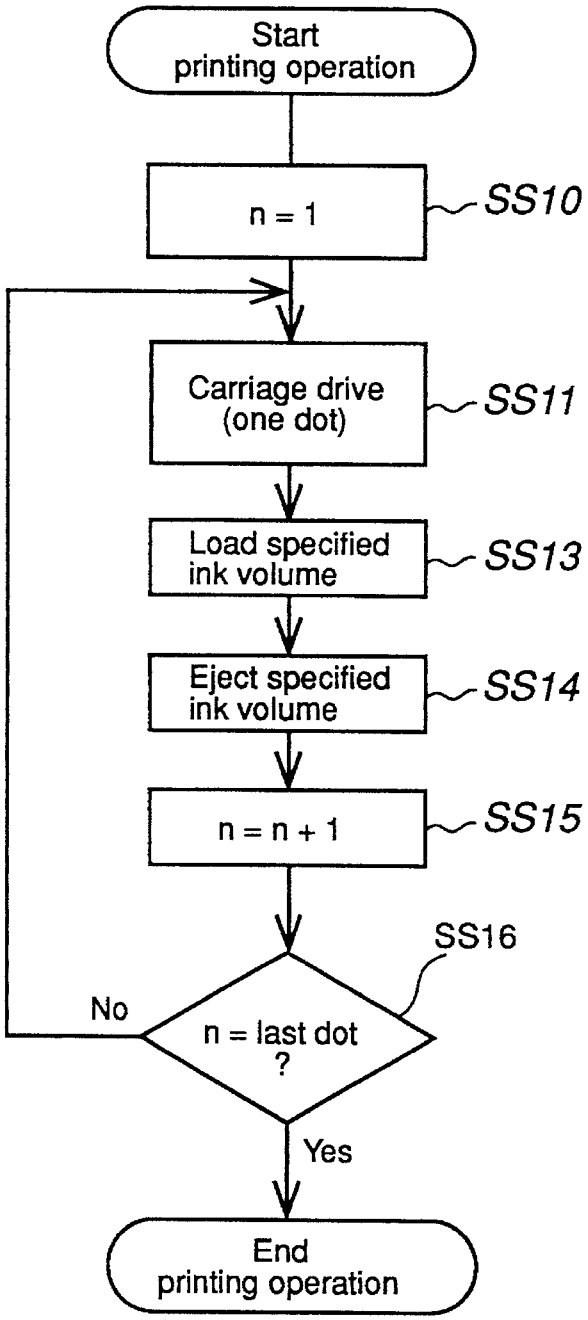

FIG. 14 is a flow chart of an alternative ink jet printer control method for the preferred embodiment of the invention shown in FIG. I and FIGS. 15(*a*) and 15(*b*) are flow charts of two subroutines shown in FIG. 14, and FIG. 15(*a*) being the nozzle refresh operation subroutine and FIG. 15(*b*) the print operation subroutine. In this embodiment, the diaphragm refresh operation is executed once each line. The diaphragm refresh operation described above is executed in the diaphragm refresh operation, step SS12, performed between steps S4 and S5 in FIG. 14. Note that, the diaphragm refresh operation of this embodiment is executed with respect to all diaphragms of the ink-jet head in order to eliminate the residual charge which accumulated during one line printing. As a result, the diaphragm refresh operation, step SS12, in the printing operation subroutine shown in FIG. 12(*b*) is eliminated from the printing operation subroutine, FIG. 15(*b*) of this embodiment, but all other procedure steps are the same.

Figure 16:
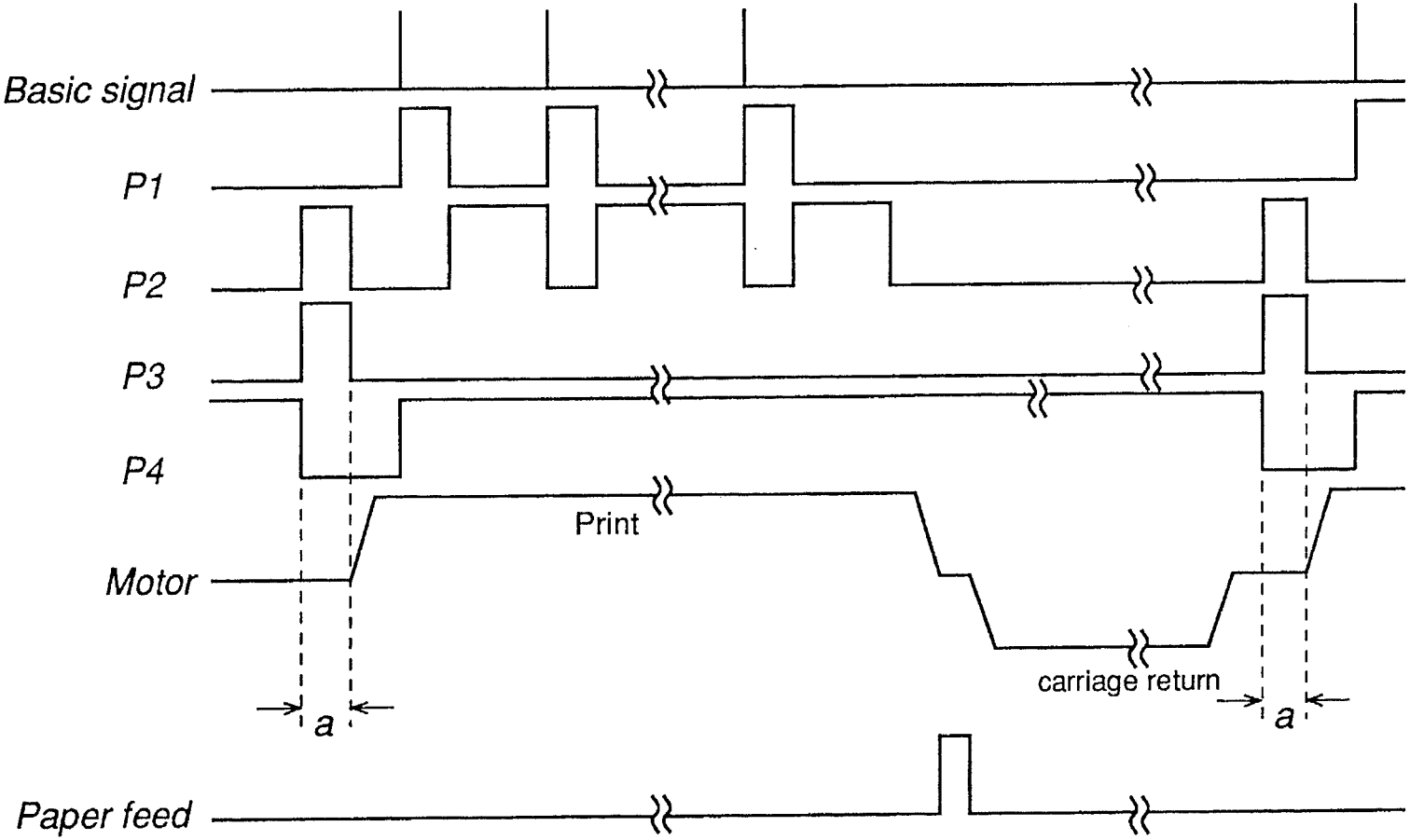
FIG. 16 is a timing chart of the operation of the second control method of FIG. 14.

FIG. 16 is a timing chart of the operation of this embodiment described in FIGS. 14 and 15. In this embodiment, pulse voltages P2 and P4 are supplied and transistors 106 and 109 turn ON during period each time carriage 302 returns, thus applying a reverse voltage to diaphragm 5 and individual electrodes 21 to eliminate the accumulated residual charge similarly as described above.

Figure 17:
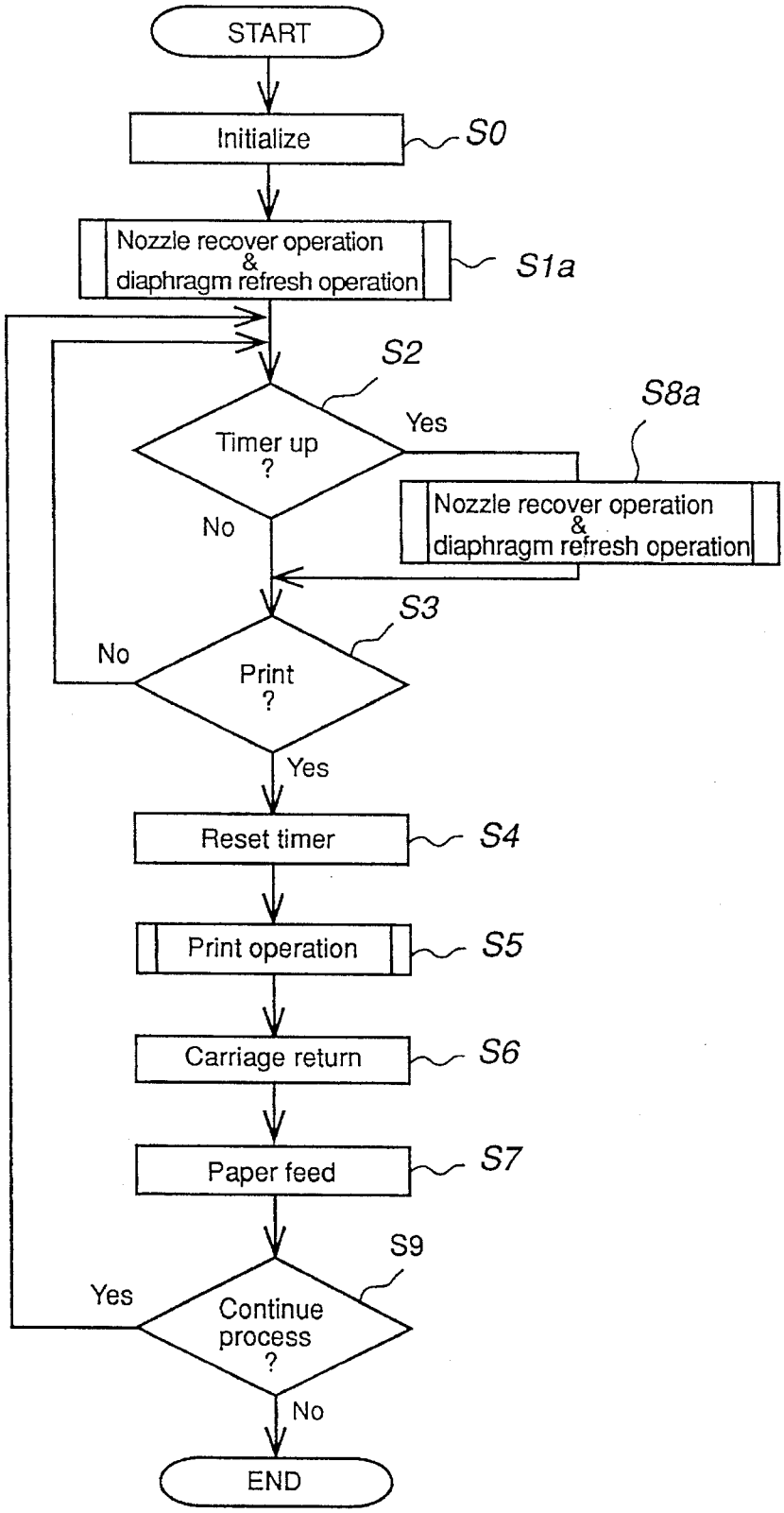
FIG. 17 is a flow chart of a third control method of an ink jet printer of the first embodiment of the present invention.
Figure 18:
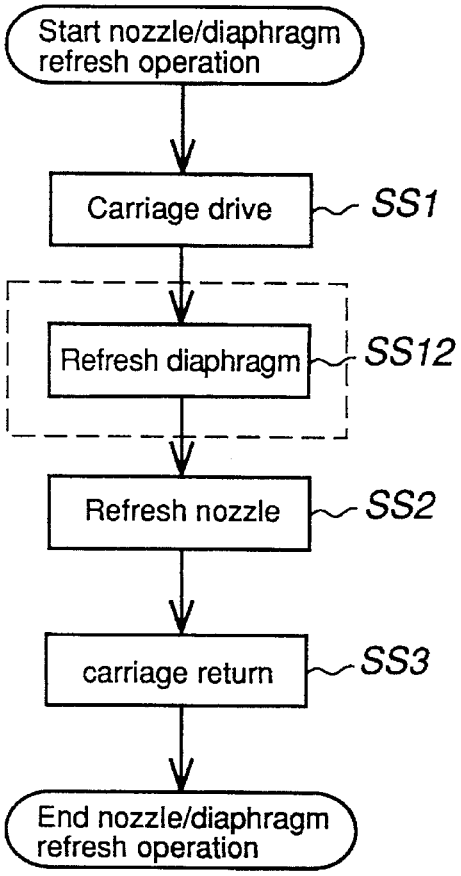
FIGS. 18(*a*) and 18(*b*) are flow charts of the subroutines of the third control method shown in FIG. 17.
Figure 18:
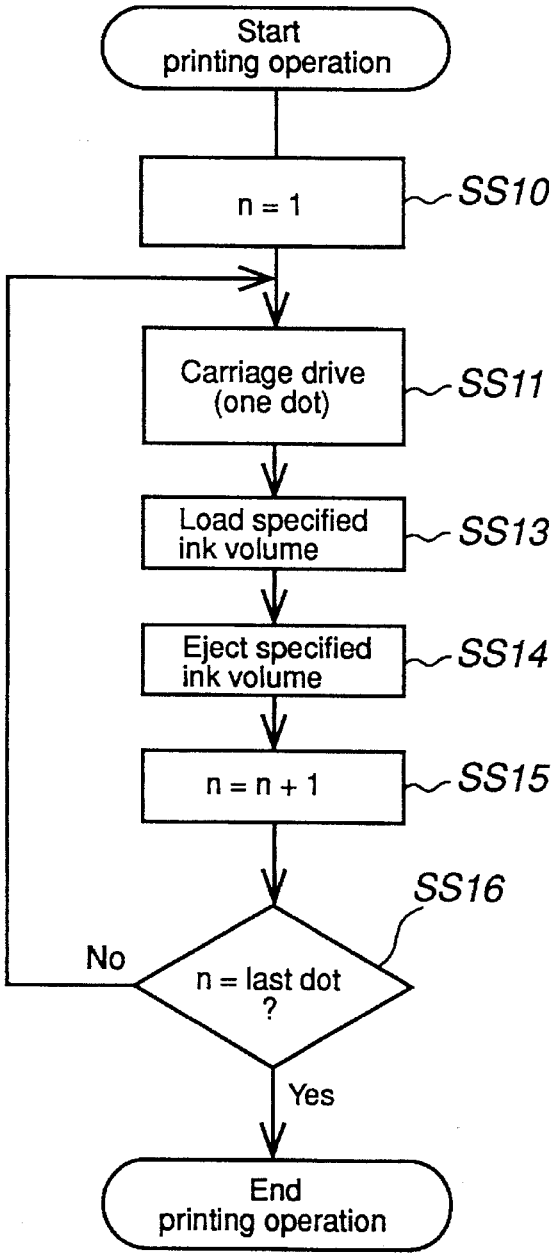

FIG. 17 is a flow chart of an alternative ink jet printer control method for the preferred embodiment of the invention shown in FIG. 1. FIGS. 18(*a*) and 18(*b*) are flow charts of two subroutines shown in FIG. 17, FIG. 18(*a*) being the nozzle/diaphragm refresh operation subroutine and FIG. 18(*b*) the print operation subroutine. In this embodiment, the diaphragm refresh operation is executed with respect to the all diaphragms of the ink-jet head at the same time as the nozzle refresh operation. Steps S1 and S8 in FIG. 11 correspond to steps S1a and S8a in FIG. 17. During steps S1a and S8a, both the nozzle refresh operation and the diaphragm refresh operation are executed. As a result, in the nozzle/diaphragm refresh operation shown in FIG. 18 (*a*), carriage 302 is moved to the standby position, step SS1, and diaphragm 5 is then refreshed in the next step, step SS12. Step SS12 from FIG. 12 is thus eliminated from the printing operation subroutine of this embodiment shown in FIG. 18(*b*).

According to the first invention described above, the influence of the residual charge is avoided by periodically removing the residual charge, either once every printed dot, once every printed line or based on a time count. Incidentally, these embodiments of the first invention may also be combined. By removing the residual charge in this way, i.e. by refreshing the diaphragms into a defined state, even if the residual deflection cannot be fully avoided, it is at least made constant. The effect of a constant residual deflection can be easily compensated for by a correspondingly increased drive voltage.

The second invention of an ink jet head drive method according to the present invention is described next. It is well known that the relationship between the dipole moment p of a molecule of a previously unipolar dielectric upon applying an electric field E is given by $$p=\alpha E$$

wherein $\alpha$ is the molecular electric polarizability. Referring to FIG. 7, the relationship $$P=\epsilon\chi Emax$$

can be defined where P is the residual field, $\chi$ may be called a residual polarizability, Emax is the maximum field strength in the applied field hysteresis, and $\epsilon$ is the dielectric constant in a vacuum. As shown by this equation, the residual field P is determined by the maximum field strength in the applied field hysteresis, and the charge from the residual field and the initial deflection of diaphragm 5 resulting therefrom are also determined by the maximum field (voltage) in the applied field hysteresis.

Figure 20:
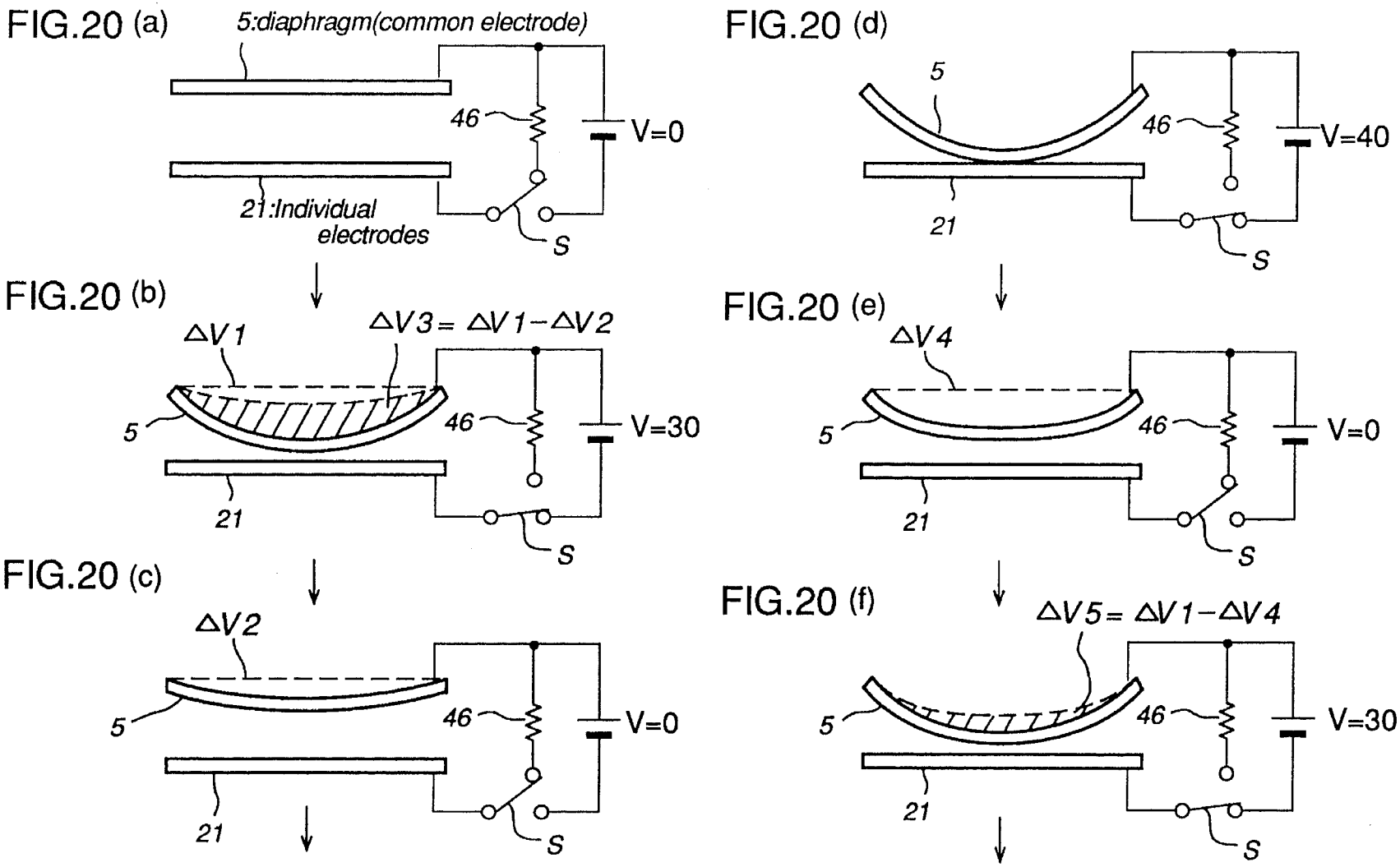

FIGS. 20(*a*)–20(*f*) show the change over time in the deflection of the diaphragm and individual electrodes. The initial zero-deflection state of diaphragm 5 with no voltage hysteresis is shown in FIG. 20(*a*). Note diaphragm 5 is substantially straight and diaphragm 5 and individual electrodes 21 are parallel with respect to one another. When a voltage, for example 30 V, is then applied to the capacitor consisting of diaphragm 5 and individual electrodes 21, diaphragm 5 deflects as shown in FIG. 20(*b*). This deflection, in this case, is $\Delta V1$. When the capacitor is discharged, diaphragm 5 assumes the state shown in FIG. 20(*c*) and has a deflection of $\Delta V2$. Because of the voltage hysteresis of the applied 30 V charge, the residual field produced by the residual charge after the voltage supply is interrupted causes diaphragm 5 to deflect slightly from the initial state shown in FIG. 20(*a*).

The ink on diaphragm 5 is eliminated and the ink elimination volume is determined by the difference between the deflection of diaphragm 5 shown in FIG. 20(*b*) and the deflection shown in FIG. 20(*c*). As explained in detail above, the ink elimination volume contributes to ejecting the ink drop, and the ink volume is the difference of relative displacement of $\Delta V3=\Delta V1-\Delta V2$ of diaphragm 5 deflection in the various states, as shown in FIG. 20(*b*).

From the state shown in FIG. 20(*c*), an even higher voltage (40 V) charge is then applied to again deflect diaphragm 5, as shown in FIG. 20(*d*) As shown in FIG. 20(*e*), Switch S selects resistance 46 to discharge the capacitor. As a result, diaphragm 5 assumes the state shown in FIG. 20(*e*).

In that figure, diaphragm 5 has a deflection of ΔV4. This magnitude of deflection is greater than that of ΔV2 shown in FIG. 20(*c*) because the residual field produced by the residual charge after the 40 V supply is interrupted is stronger than that after the 30 V supply is interrupted. Thus the strength of the residual field contributes the maximum voltage value in the hysteresis of voltage supply, and diaphragm 5 deflection is accordingly at a maximum value.

FIG. 20(*f*) shows the diaphragm 5 deflection when the same voltage, e.g., 30 V applied in FIG. 20(*b*), is again applied after FIG. 20(*e*). The diaphragm 5 deflection at this time is the same as shown in FIG. 20(*b*) or ΔV1. In this case, however, the ink elimination volume determined by the relative displacement is shown as ΔV5=ΔV1−ΔV4, which is determined by the difference between the FIG. 20(*e*) deflection and the FIG. 20(*f*) deflection. As a result, the maximum voltage value in the hysteresis of voltage supply is 40 V. As shown in those figures, ΔV3>ΔV5. It will be appreciated that the ink ejection volume varies with the level of the residual charge in the head actuator comprising diaphragm 5 and individual electrodes 21.

Figure 21:
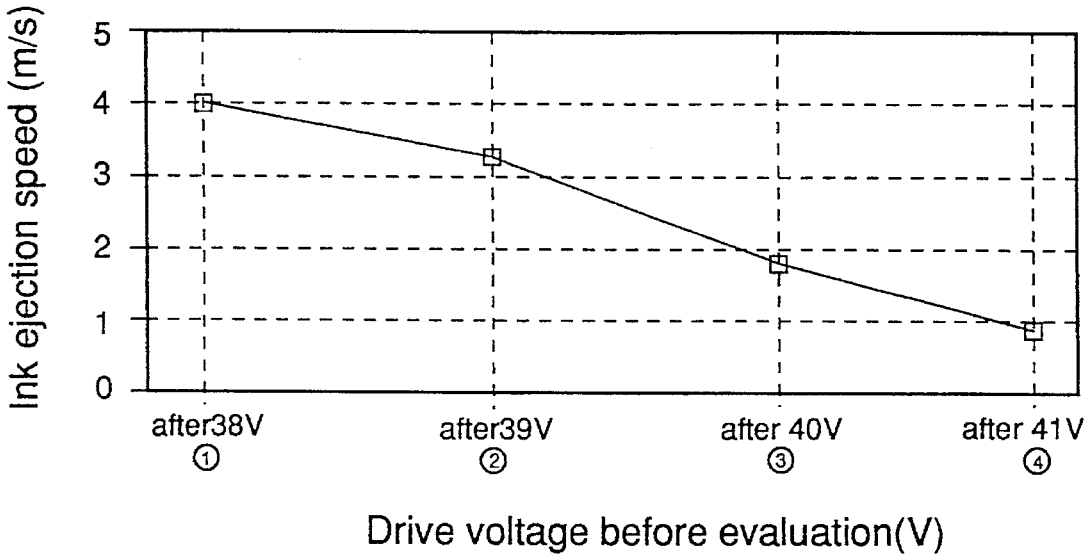
FIG. 21 is a graph illustrating the variation of the ink ejection speed at a constant (38 V) drive voltage with the drive voltage applied in the preceding period.

FIG. 21 illustrates the results of our experiments how the ink ejection speed at a constant 38 V drive voltage varies relative to the drive voltage applied in the preceding period.

Referring specifically to FIG. 21, an ink ejection speed (1) was measured after driving the ink jet head for 10 minutes at a constant 38 V drive voltage. An ink ejection speed (2) was measured after driving the ink jet head for 10 minutes at a constant 39 V drive voltage and switching the drive voltage to 38 V, and each ink ejection speed (3), (4) was after driving at 40 V and 41 V respectively. Note that the ink jet head before these experiments did not have the residual charge as shown in FIG. 20(*a*), and that a driving frequency was 3 kHz and a charging pulse was 30 μsec in these experiments. The ink ejection speed is approximately 4 m/sec. when a (1) only 38 V drive voltage is applied, 3.3 m/sec. at (2) 38 V after a 39 V drive voltage, 2.8 m/sec. at (3) 38 V after a 40 V drive voltage, and 1 m/sec. at (4) 38 V after a 41 V drive voltage.

As this illustrates, even when the drive voltage remains constant, the ink ejection speed varies according to the magnitude of the drive voltage applied in the preceding period. The cause of this is the residual charge described above.

This change in the relative displacement of diaphragm 5 and individual electrodes 21 effects a change in the ink ejection speed and ink ejection volume, and thus adversely affects ink jet printer reliability and print quality.

To counter this in the second invention, a maximum voltage is applied between diaphragm 5 and individual electrodes 21 to maintain a maximum constant residual charge and to predetermine an initial diaphragm 5 deflection and also to stabilize the ink ejection speed and volume. If a 41 V maximum voltage is applied as the first drive voltage and the drive voltage is then applied at, for example, 39 V or 40 V, the ink ejection speed at a 38 V drive voltage will be determined by the difference in diaphragm 5 deflection at a 38 V drive voltage and the deflection caused by the residual charge of the 41 V drive voltage, and will be unconditionally constant and stable.

Figure 19:
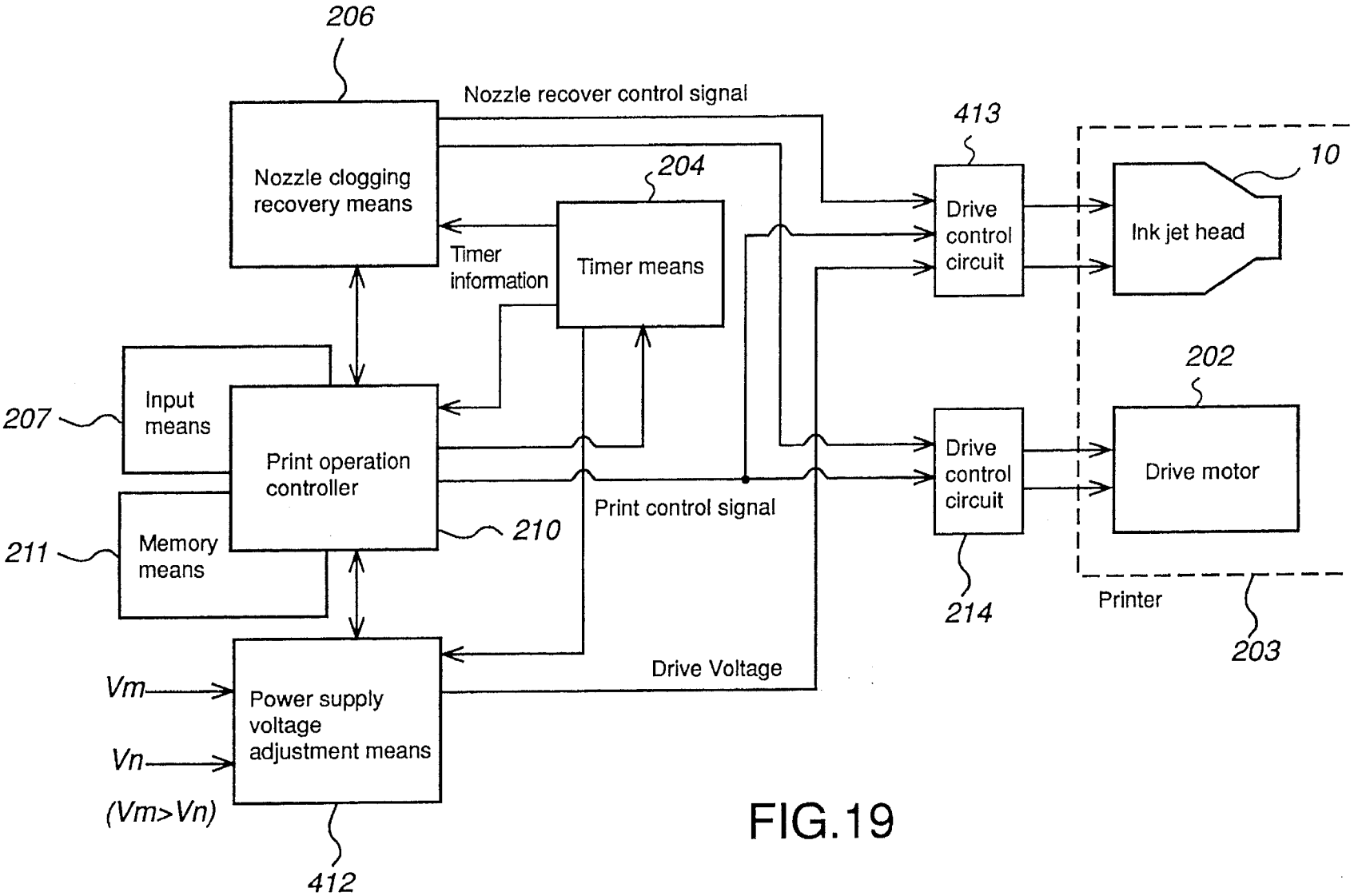
FIG. 19 is a block diagram of a printer comprising an ink jet head in accordance with a third embodiment of the invention.

The second invention of an ink jet printer according to the present invention is shown in FIG. 19. This ink jet printer further comprises a power supply voltage adjustment means 412 and drive control circuit 413.

Power supply voltage means 412 appropriately selects and outputs the normal printing drive voltage Vn and maximum voltage Vm imparting the voltage hysteresis of a known maximum voltage (where Vm>Vn) in order to avoid the effects of residual polarization of the dielectric body between diaphragm 5 and individual electrodes 21. Note that, the maximum voltage Vm should be determined by considering a tolerance of the power supply voltage, for example, when a range of the normal printing drive voltage Vn is 30 V±10%, the maximum voltage Vm may be more than 33 V at least.

Figure 22:
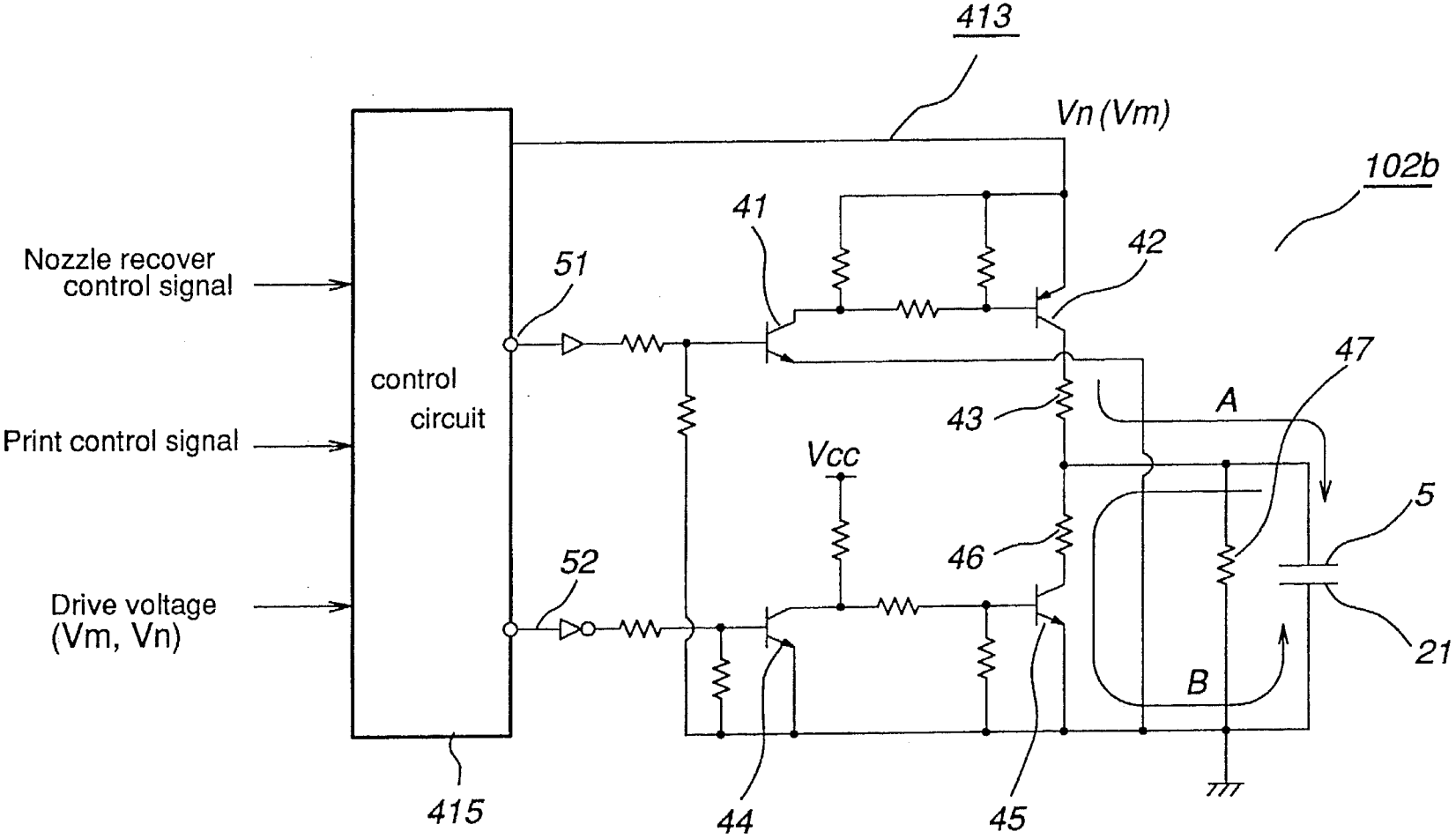
FIG. 22 is a schematic diagram of the drive control circuit for the ink jet head of the second embodiment.

Drive control circuit 413 controls ink jet head 10, and is constructed as shown in FIG. 22. The nozzle refresh control signal, print control signal, and drive voltage Vn or Vm are input to drive control circuit 413, which controls ink jet head 10 based on these control signals.

Other components and functions of the printer shown in FIG. 19 are the same as those of the printer shown in FIG. 1, and further description is therefore omitted below.

FIG. 22 is a schematic diagram of drive control circuit 413 for ink jet head 10. While the circuit of FIG. 22 is preferred, persons of ordinary skill in the art who have read this description will recognize that various modifications and changes may be made therein. As shown in the figure, drive control circuit 413 comprises control circuit 415 and drive circuit 102*b*. The nozzle refresh control signal and print control signal are input to control circuit 415, which outputs charge signal 51 and discharge signal 52 based on these input control signals. Drive circuit 102*b* comprises transistors 41, 42, 44, and 45.

When drive control circuit 4 13 is in the standby mode, transistors 42 and 45 are both OFF, and the drive voltage is not applied to diaphragm 5 and individual electrodes 21. Diaphragm 5 is therefore not displaced, and no pressure is applied to the ink in jet chamber 6. When charge signal 51 is ON, transistor 41 turns ON at the rise of charge signal 51, and transistor 42 also becomes ON. The drive voltage Vn or maximum voltage Vm is therefore applied between diaphragm 5 and individual electrodes 21. Current flows in the direction of arrow A, and diaphragm 5 is deflected towards individual electrodes 21 by the electrostatic force working bet-ween diaphragm 5 and individual electrodes 21 due to the charge accumulated therebetween. The volume of jet chamber 6 is thus increased, and ink is suctioned into jet chamber 6.

When charge signal 51 turns OFF and discharge signal 52 becomes ON, both transistors 41 and 42 become OFF, and the charging between diaphragm 5 and individual electrodes 21 stops. Transistor 44 also becomes OFF, and transistor 45 becomes ON as a result. When transistor 45 is ON, the charge accumulated between diaphragm 5 and individual electrodes 21 is discharged in the direction of arrow B through resistance 46. Because resistance 46 is significantly lower than resistance 43 and the time constant of the discharge is low in this embodiment, the accumulated charge can be discharged in sufficiently less time than the charge time.

Diaphragm 5 is immediately released from the electrostatic force at this time, and returns to the non-printing standby position due to the inherent rigidity of the diaphragm material. This rapidly compresses jet chamber 6, and the pressure produced inside jet chamber 6 causes ink drop 104 to be ejected from nozzle 4.

It is to be noted that while a p-type semiconductor is used as the substrate in this embodiment, an n-type semiconductor can be alternatively used. In this case, the connections between drive circuit 102*b* and ink jet head 10 must be reversed from those used with a p-type semiconductor.

Figure 23:
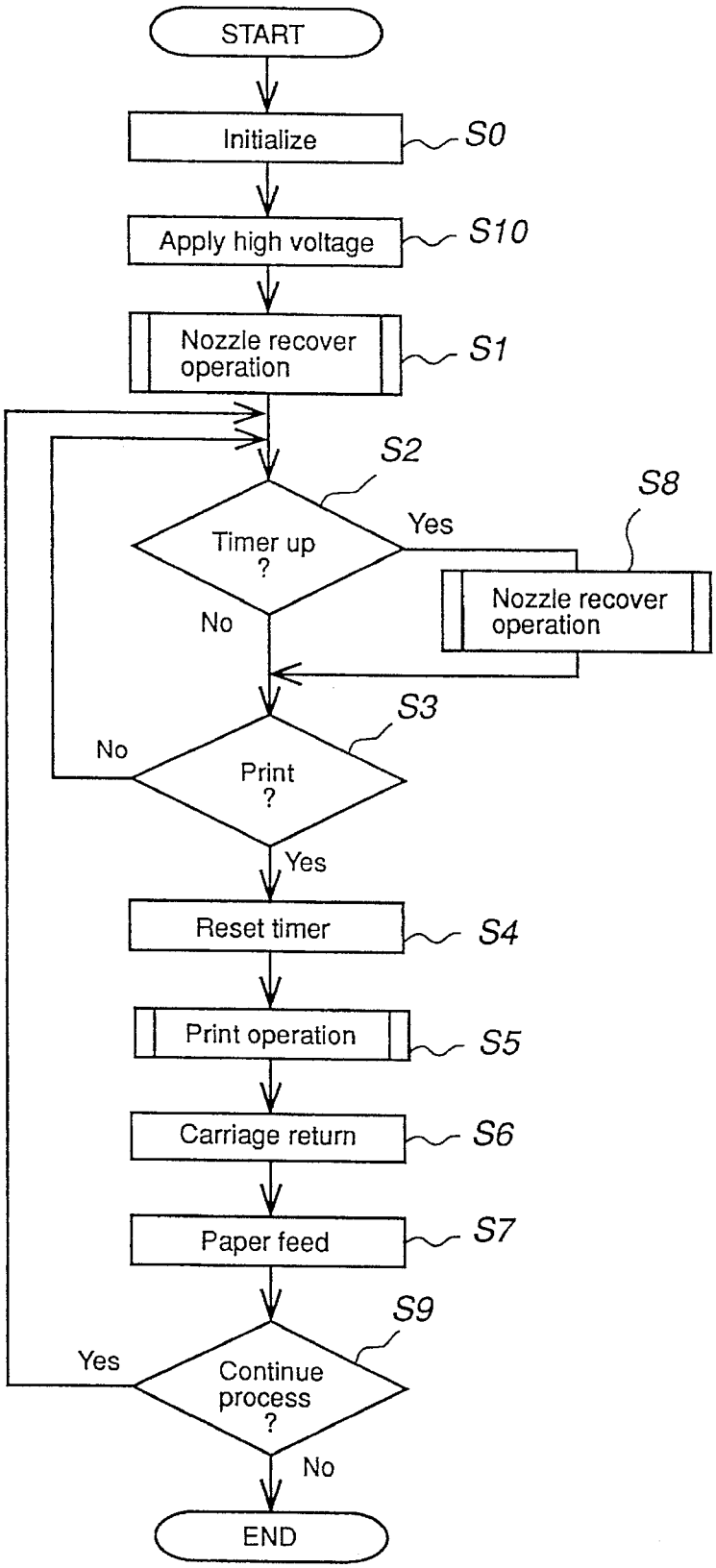
FIG. 23 is a flow chart of a control method of an ink jet printer of the second embodiment.

FIG. 23 is a flow chart of the ink jet printer control method for the embodiment of the invention shown in FIG. 19.

In this embodiment, a high voltage is applied after executing the initialization routine. The first step S0 is to initialize the printer mechanisms based on the control signals output from print operation controller 210. Timer means 204 is simultaneously reset and begins counting the time, and carriage 302 carrying ink jet head 10 is moved from the standby position to the position of cap 304 by driving drive motor 202.

At the next step S10, power supply voltage means 412 selects and outputs the maximum voltage Vm to drive control circuit 413 of ink jet head 10. The print control signal is input from print operation controller 210 to control circuit 415, which sequentially outputs charge signal 51 and discharge signal 52 to drive circuit 102*b*. The maximum voltage Vm is thus applied between diaphragm 5 and individual electrodes 21, imparting the voltage hysteresis of maximum voltage Vm to the dielectric body between diaphragm 5 and individual electrodes 21, and one ink eject, for example, is released from all nozzles. Power supply voltage means 412 then resets the output voltage to the normal print operation drive voltage Vn. The nozzle refresh operation immediately after the power is turned on is then executed at step S1. This nozzle refresh operation executes steps SS1–SS3 in the nozzle refresh operation subroutine shown in FIG. 15(*a*). This subroutine is as described above, and further description is therefore omitted.

After completing the nozzle refresh operation, timer means 204 begins counting a predetermined time. A timer up signal is checked at step S2 to determine whether timer means 204 has counted the predetermined time. If the timer up signal is detected, the procedure flows to the nozzle refresh operation, step S8, the nozzle refresh operation shown in the FIG. 15(*a*) subroutine is again executed, and the procedure then advances to step S3. If, however, the timer up signal is not detected, the procedure flows directly to step S3.

At step S3 it is determined whether to proceed with printing. If printing is not required, the procedure loops back to step S2. If printing is required, timer means 204 is reset in step S4, and the printing operation is executed in step S5.

This printing operation is controlled by the subroutine of steps SS10–SS16 shown in FIG. 15(*b*).

At step SS10 the count n is reset to 1, and carriage 302 is moved one dot, step SS11. In steps SS13 and SS14, the specified dot ink is loaded and ejected. More specifically, supplying charge signal 51 turns transistors 41 and 42 ON, thus accumulating a charge between diaphragm 5 and individual electrodes 21. Diaphragm 5 is thus deflected towards individual electrodes 21 by the electrostatic attraction force, the pressure inside jet chamber 6 rapidly drops, and ink 103 is supplied from ink cavity 8 through orifice 7 to jet chamber 6. Discharge signal 52 is then supplied, turning transistors 44 and 45 ON to rapidly discharge the charge stored between diaphragm 5 and individual electrodes 21. This discharge eliminates the electrostatic attraction force acting between diaphragm 5 and individual electrodes 21, and diaphragm 5 returns due to its inherent rigidity. The residual field at this time is dependent upon the voltage hysteresis of the past maximum voltage Vm, and diaphragm 5 is therefore slightly deflected, but the residual charge remains constant irrespective of the drive voltage hysteresis even if the drive voltage varies within the range to maximum voltage Vm.

The return of diaphragm 5 rapidly increases the pressure inside jet chamber 6, and ink drop 104 is ejected to recording paper 105 from nozzle 4. At the next step SS14, the count n is incremented to n+1. Equality of count n to the last dot count is determined in step SS15. If n does not equal the last dot, the procedure loops back to step SS11 and repeats. If n equals the last dot, the procedure exits the subroutine and advances to step S6, at which point carriage 302 is returned to the standby position, and the paper is then advanced a predetermined distance (step S7). Whether the process is to continue is evaluated in step S9; if printing is not completed, the procedure loops back to step S2 and the above operation is repeated. If printing is completed, the procedure terminates.

Figure 24:
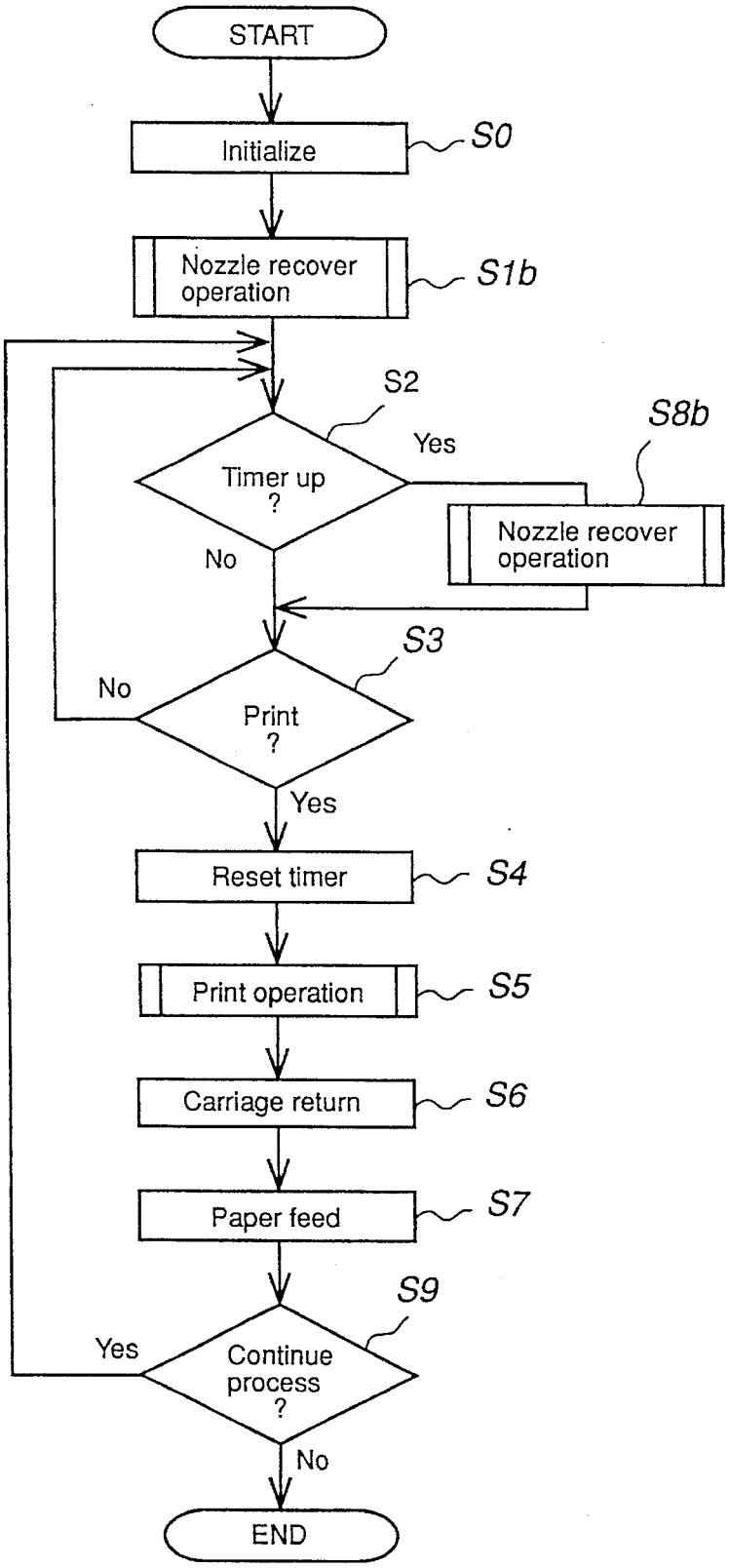
FIG. 24 is a flow chart of an alternative control method of an ink jet printer of the second embodiment.
Figure 25:
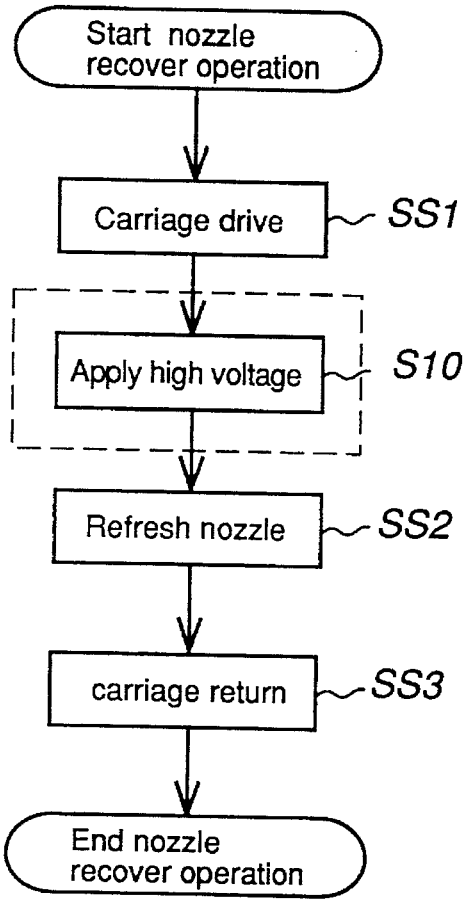
FIGS. 25(*a*) and 25(*b*) are flow charts of the subroutines of the alternate control method shown in FIG. 24.
Figure 25:
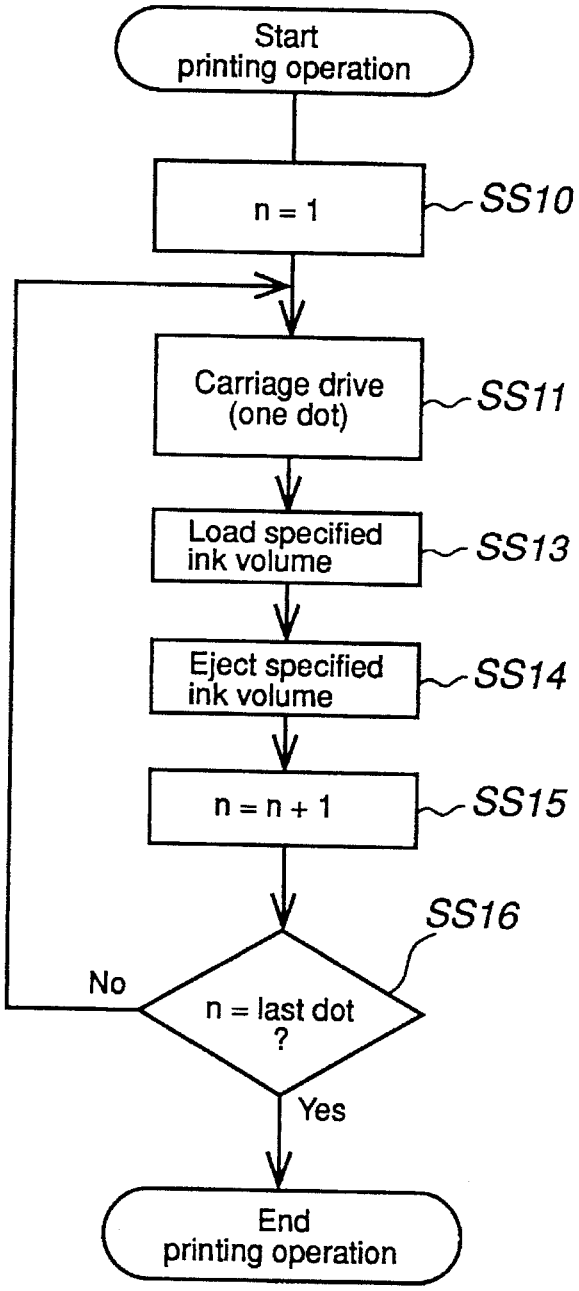
Figure 26:
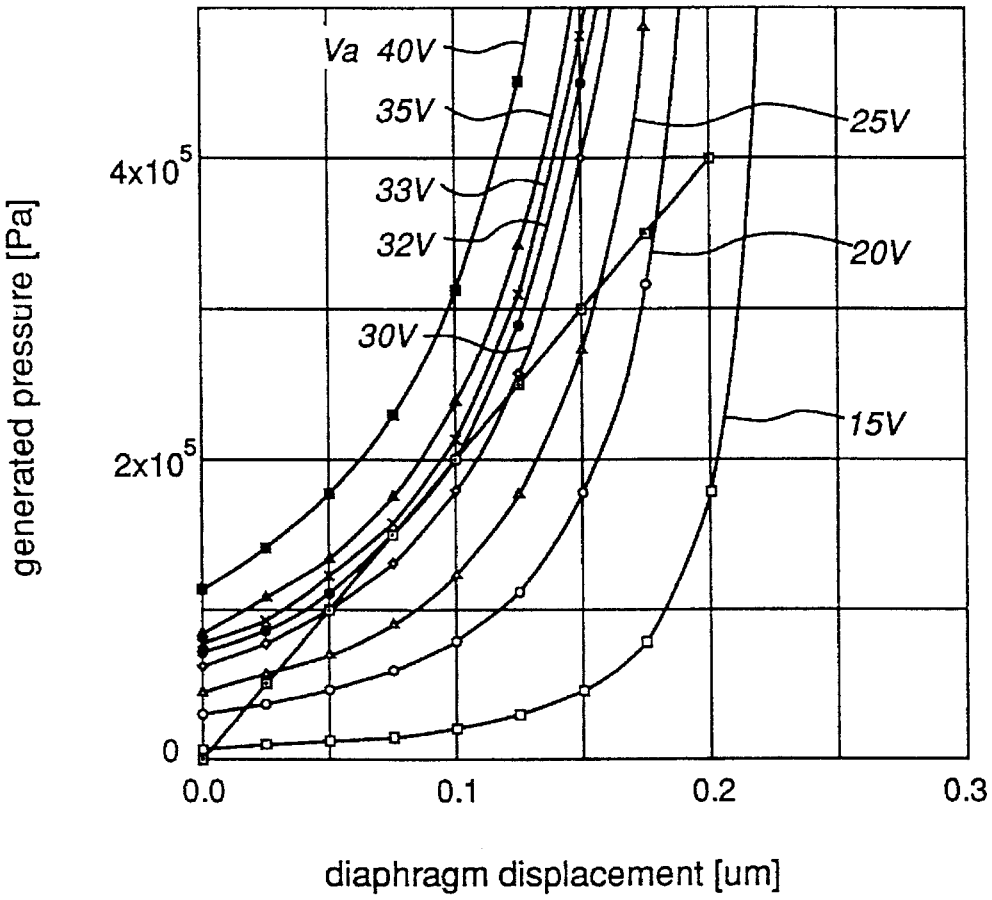
FIG. 26 is a graph illustrating the relationship between diaphragm displacement, electrostatic attraction, and the restoring force of the diaphragm.

FIG. 24 is a flow chart of an alternative ink jet printer control method for the preferred embodiment of the invention shown in FIG. 19. FIGS. 25(*a*) and 25(*b*) are flow charts of two subroutines shown in FIG. 24, FIG. 25(*a*) being the nozzle refresh operation subroutine and FIG. 25(*b*) the print operation subroutine. In this embodiment, a high voltage is applied during the nozzle refresh operation, and is specifically applied when the nozzles are refreshed by the nozzle refresh operation shown in steps S1b and S8b in FIG. 25. At step SS1, FIG. 25(*a*), carriage 302 carrying ink jet head 10 is returned from the standby position to the cap 304 position by driving drive motor 202. At step S10, the maximum voltage Vm is applied as the drive voltage as described above to eject one ink drop 104 from all of the nozzles. The normal printing drive voltage Vn is then applied, and the nozzles are refreshed in steps SS2, SS3.

It is to be noted that while maximum voltage Vm application is separated from the nozzle refresh operation in this embodiment, step S10 in FIG. 25(*a*) can be omitted and the maximum voltage Vm applied during the nozzle refresh operation of step SS2.

As will be known from the above description of the invention, in an ink jet head drive method whereby an electrostatic attraction force is effected between the individual electrodes and the diaphragm provided in opposition thereto to eject ink by applying a pulse voltage between the diaphragm and electrode, a pulse voltage of which the polarity is the reverse of that of the drive pulse voltage is applied between the diaphragm and individual electrodes to eliminate the residual charge. The diaphragm therefore returns completely to the original non-deflected position, and the relative displacement of the diaphragm and individual electrodes does not deteriorate.

In an alternative ink jet head drive method of the invention, a maximum voltage greater than the drive voltage used during normal printing is applied between the diaphragm and individual electrodes to maximize and maintain a constant residual charge. The relative displacement of the diaphragm and individual electrodes is thereby predetermined unconditionally and remains stable irrespective of voltage hysteresis.

Further, the adverse effects of residual charges causing ink eject defects are eliminated by using the above drive methods. The ink ejection volume and ink ejection speed are thus stabilized, and an ink jet head printer offering high print quality and high reliability can be provided.

While the invention has been described in conjunction with several specific embodiments, it is evident to those skilled in the art that many further alternatives, modifications and variations will be apparent in light of the foregoing description.

Thus, the invention described herein is intended to embrace all such alternatives, modifications, applications and variations as may fall within the spirit and scope of the appended claims.

What is claimed is:

1. A drive method for a printing apparatus comprising an ink jet head having a nozzle, an ink path in communication with the nozzle, an actuator consisting of a diaphragm provided at one part of the ink path and an electrode provided in opposition to the diaphragm, an insulation layer formed on one of the electrode and the diaphragm, and a drive means for applying voltages to the electrode and the diaphragm for deforming the diaphragm, thereby ejecting ink droplets from the nozzle to record, said drive method comprising the steps of:

applying a first voltage to the electrode and the diaphragm to deform the diaphragm from an initial position during a recording operation; and controlling an amount of charge in the insulation layer to restore the diaphragm to the initial position by applying a second voltage to the diaphragm and electrode at a prescribed time.

2. A drive method for a printing apparatus according to claim 1, wherein a polarity of the second voltage is opposite to a polarity of the first voltage.

3. A drive method for a printing apparatus according to claim 2, wherein the second voltage is applied to the actuator at every printing of one of a dot and a line.

4. A drive method for a printing apparatus according to claim 2, wherein the second voltage is applied to the actuator when a nozzle refresh operation is executed.

5. A drive method for a printing apparatus according to claim 1, wherein an absolute value of the second voltage is at least a maximum of an absolute value of the first voltage applied to the actuator during the recording operation.

6. A drive method for a printing apparatus according to claim 5, wherein the second voltage is applied to the actuator when one of a nozzle refresh operation is executed and an initialization of the apparatus is executed.

7. A drive method for a printing apparatus according to claim 5, wherein the absolute value of said second voltage is at least 1.1 times the absolute value of the first voltage.

8. A printing apparatus comprising:

an ink jet head having a nozzle, an ink path in communication with said nozzle, an actuator comprising a diaphragm provided at one part of said ink path, an electrode provided in opposition to said diaphragm and an insulation layer formed on one of said electrode and diaphragm; and drive means for deforming said diaphragm to thereby eject ink droplets from said nozzle for recording, said drive means comprising:

a voltage applying means for applying a first voltage to said electrode and diaphragm to deform the diaphragm from an initial position during recording, and a residual charge elimination means for controlling an amount of charge in said insulation layer to restore said diaphragm to the initial position by applying a second voltage to said electrode and diaphragm.

9. A printing apparatus according to claim 8, wherein said residual charge elimination means applies the second voltage to said actuator at every printing of one of a dot and a line.

10. A printing apparatus according to claim 8, wherein said residual charge elimination means applies the second voltage to said actuator when a nozzle refresh operation is executed.

11. A printing apparatus comprising:

an ink jet head having a nozzle, an ink path in communication with said nozzle, an actuator comprising a diaphragm provided at one part of said ink path, an electrode provided in opposition to said diaphragm and an insulation layer formed on one of said electrode and diaphragm; and drive means for deforming said diaphragm, for ejecting ink droplets from said nozzle to record, said drive means comprising a power supply voltage means for applying:

a first voltage to said electrode and diaphragm for deforming said diaphragm from an initial position during recording; and a second voltage to said diaphragm and electrode for controlling an amount of charge in said insulation layer to restore said diaphragm to the initial position.

12. A printing apparatus according to claim 11, wherein said power supply voltage means applies the second voltage to said actuator during one of a nozzle refresh operation and an initialization operation.

13. A printing apparatus according to claim 11, wherein an absolute value of the second voltage is at least 1.1 times an absolute value of the first voltage.

14. An ink jet printer provided with an ink jet print head comprising:

a nozzle;

an ink channel in communication with said nozzle;

an electrostatic actuator comprising a diaphragm which is provided in a part of said ink channel an electrode arranged outside of said ink channel opposite to said diaphragm and an insulation layer formed on one of the electrode and diaphragm; and voltage application means for applying a first voltage to said diaphragm and electrode to distort the diaphragm from an initial position to eject ink droplets from said nozzle and a second voltage to said diaphragm and electrode for controlling an amount .of charge in said insulation layer to restore said diaphragm to the initial position.

15. A method for recording on a sheet comprising the stops of:

providing a marking fluid jet head formed in a semiconductor substrate having a nozzle, a pathway in communication with the nozzle, and an actuator comprising a diaphragm provided at one part of the pathway, a first electrode provided in opposition to the diaphragm, a second electrode provided on a portion of the diaphragm and an insulation layer formed on one of the electrode and diaphragm, the first and second electrodes forming a capacitor;

applying a first driving voltage signal to the first and second electrodes to electrostatically attract the diaphragm towards the first electrode in a first direction from an initial position to fill the pathway with marking fluid; and controlling an amount of charge in the insulation layer to restore the diaphragm to the initial position by applying a second driving voltage signal to the first electrode to the second electrode.

16. The method of claim 15, wherein the semiconductor is a p-type semiconductor and the first driving voltage signal is positive.

17. The method of claim 15, wherein the semiconductor is an n-type semiconductor and the first driving voltage signal is negative.

18. The method of claim 15, further comprising the step of providing a waiting period after applying the first driving voltage and before applying the second driving voltage.

19. A method for recording on a sheet comprising the steps off providing a marking fluid jet head formed in a semiconductor substrate having a nozzle, a pathway in communication with the nozzle and a diaphragm provided at one part of the pathway;

forming a capacitor having a first electrode, a second electrode arranged on the diaphragm and an insulation layer formed on one of the electrode and diaphragm;

applying a first voltage signal to the capacitor for moving the diaphragm from an initial position to cause the pathway to fill with marking fluid; and controlling an amount of charge in the insulation layer to restore the diaphragm to the initial position by applying a second voltage signal to the capacitor.

20. A method for recording on a sheet comprising the steps off (a) providing a marking fluid jet head formed in a semiconductor substrate having an array of nozzles, corresponding pathways in communication with respective ones of the nozzles and corresponding diaphragms provided at one part of each the pathways;

(b) forming a plurality of capacitors, each corresponding to respective ones of the pathways, each one of the capacitors having a first electrode, a second electrode disposed on a corresponding diaphragm and an insulation layer formed on one of the electrode and diaphragm;

(c) selecting at least one of the nozzles for printing a pattern by:

applying a first voltage signal to charge at least a selected one of the capacitors for moving the diaphragm from an initial position to fill a respective one of the pathways with marking fluid, and controlling an amount of charge in the insulation layer to restore the diaphragm to the initial position by applying a second voltage signal to the selected ones of the capacitors charged in the previous step to thereby eject marking fluid droplets from the selected nozzles; and (d) repeating step (c) to print successive patterns.

21. A recording apparatus comprising:

a marking fluid head comprising:

a nozzle, a pathway in communication with said nozzle, and an actuator comprising:

a diaphragm provided at one part of said pathway, a first electrode provided in opposition to said diaphragm, a second electrode provided on a portion of said diaphragm, and an insulation layer disposed on one of said diaphragm and said first electrode; and a driving circuit for selectively:

applying a first driving voltage signal to said first and second electrodes to electrostatically attract said diaphragm from an initial position towards said first electrode in a first direction to fill said pathway with marking fluid and applying a second driving voltage signal to said first electrode and said second electrode for controlling an amount of charge in said insulation layer to restore the diaphragm to the initial position to thereby eject said marking fluid from said nozzle.

22. The recording apparatus of claim 21, wherein a duration of the first driving voltage signal is greater than a duration of the second driving voltage signal.

23. The recording apparatus of claim 21, wherein a duration of the first driving voltage signal is less than a duration of the second driving voltage signal.

24. The recording apparatus of claim 21, wherein a duration of the first driving voltage signal is equal to a duration of the second driving voltage signal.

* * * * *

UNITED STATES PATENT AND TRADEMARK OFFICE

CERTIFICATE OF CORRECTION

PATENT NO. : 5,563,634

DATED : October 8, 1996

INVENTOR(S) : Masahiro Fujii, et al.

It is certified that errors appear in the above identified patent and that said Letters Patent is hereby corrected as shown below:

Column 22, Line 29, insert --,-- after "channel",

Line 41, change "stops" to --steps--.

Column 23, Line 5, change "off" to --of:--,

Line 20, change "off" to --of:--.

Signed and Sealed this

Fourth Day of March, 1997

*Attest:*

*Attesting Officer*

BRUCE LEHMAN

*Commissioner of Patents and Trademarks*